US010988911B2

(12) United States Patent
Coupland

(10) Patent No.: US 10,988,911 B2
(45) Date of Patent: Apr. 27, 2021

(54) DIAPHRAGM WALLS

(71) Applicant: CCMJ SYSTEMS LTD, Strathpeffer (GB)

(72) Inventor: John Coupland, Strathpeffer (GB)

(73) Assignee: CCMJ SYSTEMS LTD, Strathpeffer (GB)

( * ) Notice: Subject to any disclaimer, the term of this patent is extended or adjusted under 35 U.S.C. 154(b) by 251 days.

(21) Appl. No.: 16/328,609

(22) PCT Filed: Mar. 20, 2018

(86) PCT No.: PCT/GB2018/050716
§ 371 (c)(1),
(2) Date: Feb. 26, 2019

(87) PCT Pub. No.: WO2018/197828
PCT Pub. Date: Nov. 1, 2018

(65) Prior Publication Data

US 2020/0340201 A1 Oct. 29, 2020

(30) Foreign Application Priority Data

Apr. 26, 2017 (GB) ..... 1706643

(51) Int. Cl.
*E02D 17/13* (2006.01)
*E02D 19/18* (2006.01)
(Continued)

(52) U.S. Cl.
CPC ..... *E02D 29/16* (2013.01); *E02D 5/14* (2013.01); *E02D 5/185* (2013.01); *E02D 17/13* (2013.01); *E02D 19/18* (2013.01)

(58) Field of Classification Search
CPC ..... E02D 5/14; E02D 5/185; E02D 17/13; E02D 19/18; E02D 29/16
See application file for complete search history.

(56) References Cited

U.S. PATENT DOCUMENTS

RE25,102 E 12/1961 Buzzell et al.
3,422,627 A 1/1969 Courte
(Continued)

FOREIGN PATENT DOCUMENTS

CN 1143703 A 2/1997
CN 101560767 A 10/2009
(Continued)

OTHER PUBLICATIONS

Casagrande, FG, The joint forming mill was designed to be used in the construction of diaphragm walls, to replace the conventional stop-end tube for the formation of joints between adjacent panels. Casagrande, Innovat & Technol, Nov. 22, 1993, 9 pages.
(Continued)

*Primary Examiner* — Benjamin F Fiorello
(74) *Attorney, Agent, or Firm* — Moore & Van Allen PLLC; W. Kevin Ransom

(57) ABSTRACT

The invention relates to apparatus and methods for constructing diaphragm walls. A guideway tube is provided for casting into a concrete panel along a height of a face of the concrete panel, comprising: an elongate guideway track comprising at least one elongate side wall and an elongate slot along the at least one elongate side wall, the elongate slot having a first width; and, an elongate closure panel comprising: a rear panel portion configured to close the elongate slot enclosing an elongate internal volume, and, a front panel portion of a second width greater than the first width. Preferably the rear panel portion is a close fit within elongate slot sufficient to resist the ingress of slurry and concrete. Preferably the rear panel portion is configured to engage the elongate slot in a manner configured to resist compression forces.

21 Claims, 12 Drawing Sheets

(51) Int. Cl.

| | |
|---|---|
| ***E02D 5/14*** | (2006.01) |
| ***E02D 29/16*** | (2006.01) |
| ***E02D 5/18*** | (2006.01) |

(56) References Cited

U.S. PATENT DOCUMENTS

| | | | | |
|---|---|---|---|---|
| 3,431,736 | A | 3/1969 | Ueda | |
| 3,464,665 | A | 9/1969 | Schoewert | |
| 3,759,044 | A | 9/1973 | Caron et al. | |
| 3,796,054 | A | 3/1974 | Piccagli | |
| 3,798,914 | A | 3/1974 | Irwin | |
| 3,938,292 | A | 2/1976 | Kawasaki | |
| 4,367,057 | A | 1/1983 | Hughes | |
| 4,582,453 | A | 4/1986 | Ressi | |
| 4,838,980 | A | 6/1989 | Glaeser et al. | |
| 4,930,940 | A | 6/1990 | Charlier | |
| 4,990,210 | A | 2/1991 | Glaeser et al. | |
| 5,007,222 | A * | 4/1991 | Raymond | E04B 1/0023 52/220.1 |
| 5,056,242 | A | 10/1991 | Miotti | |
| 5,056,959 | A | 10/1991 | Cannac et al. | |
| 5,263,798 | A | 11/1993 | Dupeuble et al. | |
| 5,548,937 | A | 8/1996 | Shimonohara | |
| 6,018,918 | A | 2/2000 | Long | |
| 6,052,963 | A | 4/2000 | Lefort et al. | |
| 6,164,873 | A | 12/2000 | Miotti et al. | |
| 6,276,106 | B1 | 8/2001 | Shotton et al. | |
| 8,348,555 | B2 | 1/2013 | Stoetzer et al. | |
| D823,487 | S * | 7/2018 | Peterson | D25/138 |
| 2002/0119013 | A1 | 8/2002 | Shotton | |
| 2013/0227862 | A1 | 9/2013 | Schroeppel et al. | |
| 2013/0255180 | A1 | 10/2013 | Daubner et al. | |
| 2014/0013634 | A1 | 1/2014 | Huber | |
| 2014/0219730 | A1 * | 8/2014 | Coupland | E02D 17/13 405/287 |

FOREIGN PATENT DOCUMENTS

| | | | |
|---|---|---|---|
| CN | 101858090 | A | 10/2010 |
| CN | 204753651 | U | 11/2015 |
| CN | 106013086 | A | 10/2016 |
| DE | 3430789 | A1 | 3/1986 |
| DE | 3430790 | A1 | 3/1986 |
| DE | 3503542 | A1 | 10/1986 |
| DE | 3634906 | A1 | 4/1988 |
| DE | 4016388 | A1 | 11/1990 |
| DE | 9001679 | U1 | 7/1991 |
| DE | 4428513 | A | 2/1995 |
| DE | 69201743 | T2 | 7/1995 |
| DE | 19901556 | A1 | 8/2000 |
| DE | 202011051438 | U1 | 11/2011 |
| EP | 0101350 | B1 | 5/1986 |
| EP | 0290303 | A1 | 11/1988 |
| EP | 0333577 | A1 | 9/1989 |
| EP | 0402247 | A1 | 12/1990 |
| EP | 0411682 | A1 | 2/1991 |
| EP | 0509934 | A1 | 10/1992 |
| EP | 0580926 | A1 | 2/1994 |
| EP | 0649716 | A1 | 4/1995 |
| EP | 0833987 | B1 | 1/2001 |
| EP | 0981672 | B1 | 9/2004 |
| EP | 1788157 | A2 | 5/2007 |
| EP | 1983111 | A1 | 10/2008 |
| EP | 1803853 | B1 | 9/2009 |
| EP | 1847650 | B1 | 11/2009 |
| EP | 2647765 | A1 | 10/2013 |
| FR | 2594864 | A1 | 8/1987 |
| FR | 2708946 | A1 | 2/1995 |
| GB | 1137861 | A | 12/1968 |
| GB | 1481186 | A | 7/1977 |
| GB | 1590325 | A | 5/1981 |
| GB | 2315803 | A | 2/1998 |
| GB | 2325262 | A | 11/1998 |
| GB | 2492890 | A | 1/2013 |
| IT | 1150926 | B | 12/1986 |
| IT | UD920082 | A1 | 11/1993 |
| IT | UD930212 | A1 | 4/1995 |
| JP | S4963709 | U | 6/1974 |
| JP | 10245843 | A | 9/1998 |
| JP | 2006070608 | A | 3/2006 |
| RU | 2288323 | C1 | 11/2006 |
| WO | 2011120557 | A1 | 10/2011 |
| WO | 2013007968 | A2 | 1/2013 |
| WO | 2016077363 | A1 | 5/2016 |

OTHER PUBLICATIONS

Coupland, Channel Tunnel Rail Link-Contact 220 Graham Road Deep Vent Shaft. Proceed Internl Conf Case Histories Geotech Engineer, New York, NY, Apr. 13-17, 2004; paper 5.47, 4 pages.

Nicholson, Diaphragm Walls. Downloaded from web Jun. 23, 2001, http://www.nicholsonconstruction.com/techResources/datasheets/PDF/DiaphragmWall_Tech_Web.pdf : 1 page.

Richards and Nicholson, Diaphragm Walls. 21st Central PA Geotechnical Conference—Mar. 23-25, 2005. Presented Mar. 23-25, 2006, 18 pages.

CCMJ Systems LTD, International Application No. PCT/GB2018/050716, International Search Report, dated Jun. 28, 2018.

CCMJ Systems LTD, International Application No. PCT/GB2018/050716, Written Opinion, dated Jun. 28, 2018.

* cited by examiner

Fig. 6
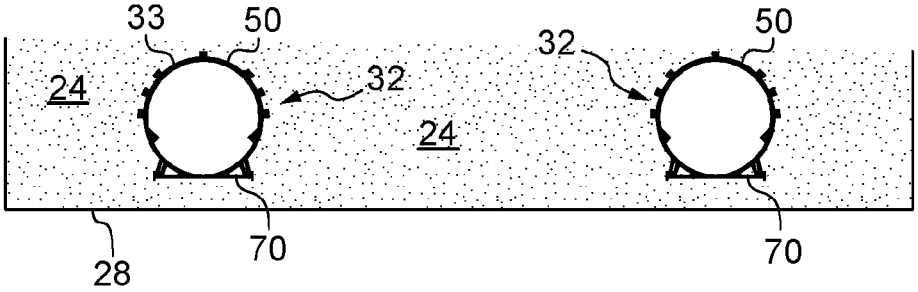
Fig. 7
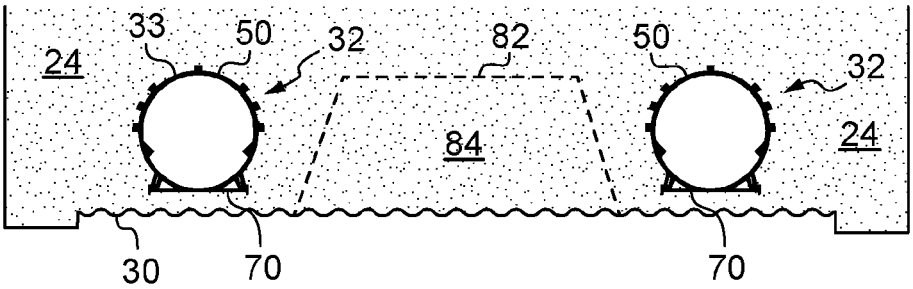
Fig. 8
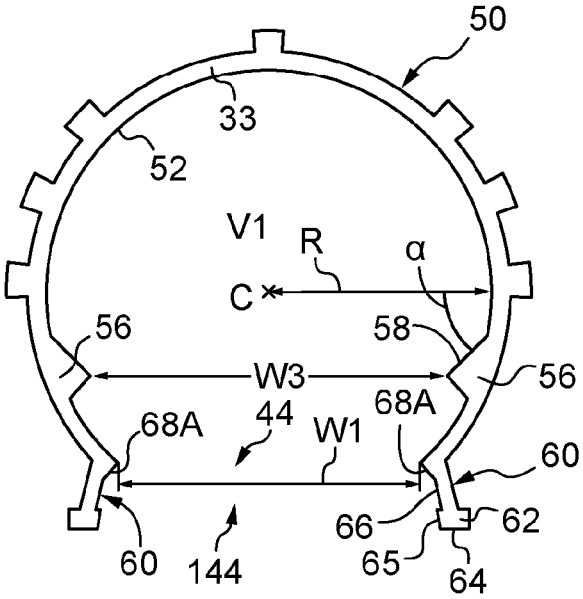
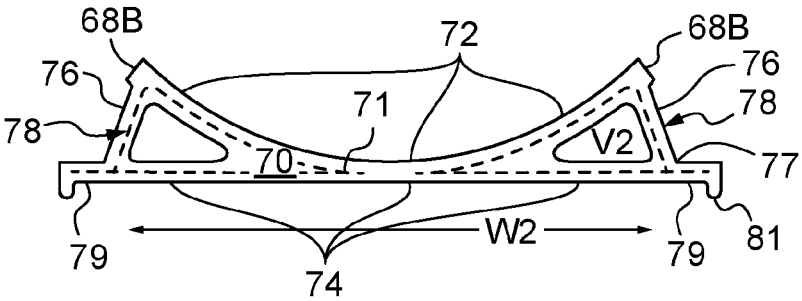
Fig. 9

DIAPHRAGM WALLS

CROSS-REFERENCE TO RELATED APPLICATIONS

This application is a national stage application (filed under 35 § U.S.C. 371) of PCT/GB2018/050716, filed Mar. 20, 2018 of the same title, which, in turn, claims priority to Great Britain Application No. GB1706643.2, filed Apr. 26, 2017 of the same title; the contents of each of which are hereby incorporated by reference.

FIELD OF THE INVENTION

The invention relates to apparatus and methods for constructing walls, in particular concrete embedded retaining walls such as diaphragm walls, comprising one or more panels, and walls so constructed. In particular the invention relates to apparatus, methods and walls, in particular concrete embedded retaining walls such as diaphragm walls, and kits comprising the apparatus.

BACKGROUND OF THE INVENTION

Concrete embedded retaining walls such as diaphragm walls, known as slurry walls in the USA, have been part of foundation construction for sixty years. Forming the joint between successive panels has always been one of the most difficult and time consuming elements of the process. Existing construction methods of forming joints involves using, and then removing, stop-ends. Precast concrete stop-ends have also been used occasionally.

In one sense precast concrete 'stop-ends' are a retrograde step. This is because double the number of joints in any wall increases the risk of leakage and the nature of the stop-end construction does not lend itself to effective incorporation of water bars, further compromising water tightness. Many construction companies use steel 'stop-ends', known by a variety of terms including 'end stops' and 'shuttering elements'. These 'stop-ends' function as an elongate, vertical shuttering for the concrete to provide a formed end-face of predetermined profile. Typically the stop-ends are the same width as the trench, to prevent concrete from a first concrete panel seeping around and embedding the stop-end in concrete. The stop-end is removed from the trench before pouring the second panel, its purpose being to provide a 'formed' or 'shaped' end face of a first concrete panel e.g. with a shear key recess, against which a second concrete panel can be poured, without requiring cutting or milling to prepare the first panel end face. Removing such stop-ends from the depths required (e.g. 30-80 m) is considerably problematic in practice.

Stop-ends, end-stops and shuttering elements and methods are described in U.S. Pat. No. 4,582,453 RESSI, EP0101350 DUPEUBLE, U.S. Pat. No. 5,263,798, DE69201743, DE0509934 all to DUPEUBLE, U.S. Pat. No. 6,052,963 LEFORT, U.S. Pat. No. 3,422,627 COURTE, GB1590325 COMAR REG, GB1481186 CALDERWOOD, US2013/0255180 and EP2647765 both to DAUBNER, GB2315803 GRABNER, DE202011051438U, DE3430790 ZUBLIN, U.S. Pat. No. 6,164,873 MIOTTI, U.S. Pat. No. 3,464,665 SCHOEWERT, EP0290303 SCHREIBER, and DE9001679U BAUER.

Preparing of a first panel end face is described in FR2594864 ROCHMANN, U.S. Pat. No. 4,930,940 and EP0333577 CHARLIER, EP0649716 CASAGRANDE, EP0402247 and U.S. Pat. No. 5,056,959 both to CANNAC, DE19901556 BRUCKNER, ITUD930212 CASAGRANDE, EP1847650 CASAGRANDE, and WO2013007968 COUPLAND.

Provision of couplings e.g. tension joints between reinforcement cages of adjacent panels, is described in U.S. Pat. No. 4,838,980, DE3430789, U.S. Pat. No. 4,990,210, and DE3503542 all to GLASER, EP1788157 VELTHORST, EP0833987 LEFORT, IT1150926 FENOUX, and U.S. Pat. No. 3,798,914 IRWIN CHILDS.

Provision of water-stops and water bars between adjacent panels is described in GB2325262, U.S. Pat. No. 6,276,106, EP0981672 all to SHOTTON, EP0411682 VERSTRAETEN, EP0580926 MIATELLO, US2002/0119013 SHOTTON, FR2708946 and DE4428513 both to SYDORAK, U.S. Pat. No. 4,367,057 HUGHES, U.S. Pat. No. 3,796,054 PICCAGLI, DE4016385 FISCHER, DE3634906 BEINBRECH, EP1983111 STOTZER, and US25102 BUZZELL.

Use of pre-cast concrete panels is described in U.S. Pat. No. 5,056,242 MIOTTI.

General background to formation of diaphragm walls is found in CN101560767 LIXIN TAN, CN101858090 CUI, IT259721 CASGRANDE, U.S. Pat. No. 3,759,044 CARON, GB1137861 SOLETANCHE, EP1803853 MAURO, RU2005110297 VJACHESLAVOVICH, JP2006070608 MURASAWA, JP10245843 ARIYAMA, CN1143703 AISEN, "FG *Joint Forming Mill Innovation and Technology*" CASAGRANDE—FG Joint Mill Sales Brochure, "*Channel Tunnel Rail Link—Graham Road Deep Vent Shaft*." Proc. 5$^{th}$ International Conference on Geotechnical Engineering 13-17 Apr. 2004 COUPLAND, "*Diaphragm Walls*" by Nicholson (Soletanche Bachy), "*Diaphragm Walls*", Central PA Geotechnical Conference 23-25 Mar. 2006 RICHARDS, U.S. Pat. No. 3,431,736 UEDA, U.S. Pat. No. 5,548,937 SHIMONOHARA, and U.S. Pat. No. 6,018,918 LONG.

FR2594864 ROCHMANN and WO2013/007968 COUPLAND describe use of hollow guideways.

The present inventor filed International patent application WO2013/0079868 COUPLAND, the entire contents of which are included for reference. In particular, reference is made to the cutting machine(s) described in WO2013/0079868.

FR2594864 ROCHMANN describes a hollow section 10 with a gasket 16 (FIG. 2), a solid profile 20 e.g. of polyurethane foam (FIG. 3) and an inflatable section 30A (FIG. 4) to prevent entry of concrete. Portion 15 of the reinforcement frame supports the hollow section 10 to avoid tearing when subject to horizontal loads. Blade 54 penetrates channel 58 to destroy the sealing gasket.

ROCHMANN describes a 4 stage process of firstly casting a vertical hollow section in a first concrete panel, next in a first pass pushing out or destroying a gasket and then apparently in a second pass using the opened vertical hollow section as a guide for trimming the wall, before digging and casting the second panel against the trimmed wall. Reverse facing portion 15 of the reinforcement prevents the hollow section from being torn when subjected to horizontal loads.

COUPLAND describes use of guideways with a sacrificial wall portion that may be cut away, "the cutaway portion of the guideway tube 32 may be removed completely, or may be cut open, in either case it is cut away to allow ingress of slurry (and later concrete)".

COUPLAND describes a 3 stage process of firstly casting a vertical guideway tube in a first concrete panel, next in a single pass cutting away a sacrificial portion and using the opened guideway tube as a guide for a trimming the wall, before (or after) this, digging the second panel against the trimmed wall and then casting the concrete to form the second panel.

COUPLAND represented a considerable improvement over ROCHMANN. Nevertheless, further technical challenges remain in this highly challenging process of joining concrete panels at immense depths.

In COUPLAND the opening in the guideway tube provided by the cutting action works well to allow ingress of concrete but is not well defined. Furthermore, the cut may not be formed over the entire length of the guideway tube, which is no problem in COUPLAND, but which can limit the utility of the opening formed.

Furthermore, it is difficult to locate water bars (also known as water-stops) along the vertical end face of a concrete panel. COUPLAND describes using a water bar 146 in guideway tube 32 (FIG. 15). Hydrophilic material in the form of strips 152 may be positioned about pipe 142 of water bar 140 within guideway tube 32. COUPLAND also describes a water seal tube 158 with a sacrificial element 282 into which a water bar 140 can be inserted (FIG. 16B).

Improvements in installation and positioning of water bars are still required particularly when desirous of extending the waterproofing beyond the location of the guideway tube, and/or when it is desired to know the position of the waterproofing more accurately.

Modern hydraulic diaphragm wall milling machines, cutters and grabs are capable of digging to depths of over 60 m with a high degree of positional accuracy. Diaphragm wall panel jointing systems and waterproofing systems have not kept pace with the development of milling, cutting and digging machines.

SUMMARY OF THE INVENTION

In one aspect the invention provides an apparatus for a diaphragm wall comprising a guideway tube for casting into a concrete panel (24, 26) of a diaphragm wall along a height of a face of the concrete panel, the guideway tube (32) comprising: an elongate guideway track (50) comprising at least one elongate side wall (33) and an elongate slot (44) along the at least one elongate side wall (33), the elongate slot (44) having a first width (W1), the guideway tube (5) further comprising: an elongate closure panel (70) comprising a rear panel portion (72) configured to close the elongate slot (44) enclosing an elongate internal volume (V1) and a front panel portion (74) of a second width (W2) greater than the first width (W1). Preferably, at least the rear panel portion 72 of the elongate closure panel 70 is retained by a friction fit (also known as an interference fit) within elongate slot 44. The closure panel 72 may also or alternatively be attached to the guideway track 50 by attachment members 80 of (relatively) low mechanical strength. In any case, preferably the rear panel portion (72) is a close fit within elongate slot (44) sufficient to resist the ingress of slurry and concrete. Preferably the rear panel portion 72 is configured to engage the elongate slot 44 in a manner configured to resist compression forces.

Preferably, the at least one elongate side wall (33) of the guideway tube (32) comprises two opposing elongate first free end faces (68A) defining the elongate slot (44), and the rear panel portion (72) comprises two co-operating elongate second free end faces (68B) that engage the first free end faces (68A), enclosing the internal volume (V1). In this way, the side wall (33) and the rear panel portion (72) provide a continuous peripheral side wall of continuous circumference (33, 72) e.g. a ring-shaped structure, which is resistant to compression forces. Preferably the ring-shaped structure is of generally, or substantially, circular cross-section. Removal of the closure panel (70) leaves a well-defined slot 44, or extended slot 144, de-limited by well-defined features of known (or determinable) position (e.g. end faces 68A and/or wings (60)) that can then be advantageously utilized.

Preferably, the rear panel portion (72) is curved e.g. arched, parabolic or circular. Preferably, the guideway tube (32) is of generally or substantially circular cross-section. Preferably, the side wall (33) and rear panel portion (72) are of generally, or preferably substantially, circular cross-section.

Preferably, the guideway track (50) comprises one, or preferably two, elongate wing(s) (60) each extending externally from the at least one side wall (33) adjacent respective first free end faces (68A) of elongate slot (44). Whilst only one wing (60) may be provided, two opposing wings (60) are preferred. Preferably, the elongate wings (60) are angled with respect to each other to provide a wedge shaped volume therebetween. In this way, wings 60 provide a narrowing at slot 44 leading into the internal volume V1. The elongate wings (60) and slot (44) provide, in effect, an extended elongate slot (144) of generally wedge-shaped cross-section, between wings 60.

Preferably, the elongate wings (60) each have one or more of i) an enlarged distal end (62) ii) a distal corner element (64, 65) (e.g. formed from front face (64) and side face (65) at a distal end e.g. at an enlarged distal end (62)) iii) an inwardly projecting profiled (preferably rounded) rear distal edge (162A), iv) an outwardly projecting profiled (preferably rounded) front distal edge (162B). Preferably, at least one of the elongate wings (60) has an elongate side wall recess (66) facing inwardly along a central portion of an inner face. Recess (66) assists in better defining a first elongate free end face (68A), enlarged distal end (62) and distal corner element e.g. front and side faces (64, 65) of elongate wing(s) 60.

Preferably, the closure panel (70) has a central axis of symmetry, e.g. extending along its length, and either side thereof a generally wedge shaped cross-section; and/or the rear and front panel portions (72, 74) meet at a central portion of closure panel (70) and diverge from one another in a lateral direction away from a central axis of symmetry.

Preferably, an elongate closure panel side wall (78) is provided between respective distal ends of rear and front panel portions (72, 74). Preferably a volume V2 is thereby enclosed to provide an elongate hollow box section, preferably of generally triangular cross-section. Preferably, the elongate closure panel side wall (78) comprises an elongate side wall recess (76) along a central portion of an outer face. Recess (76) assists in better defining a second elongate free end face 68B of rear panel portion (72) and a shaped recess (77) for receiving and locating enlarged distal end (62) of wings (60) e.g. a corner recess (77) for receiving the corners formed from front and side faces (64, 65) of a distal end (62).

Preferably, the front panel portion (74) comprises two elongate side extensions (79) at each lateral elongate edge thereof for engaging with a distal end (62), or with an outwardly projecting profiled (preferably rounded) front distal edge (162B) where provided, of a respective wing (60).

Corner recess element 77 is formed to accommodate angled end faces 64 and 65 at distal ends of wings 60. Indeed, elongate side extensions 79 form (with recess 76 and side wall 78) corner recess 77 which is arranged to cooperate with distal end 62 to position closure panel 70 accurately within the slot 44 (and within the extended slot 144 between wings 60) and, in particular, to locate free end faces 68B of rear panel portion 72 between free end faces 68A of side wall 33 to provide a sufficiently tight seal there between preferably both to resist ingress of concrete and preferably also to form (in effect) a continuous peripheral side wall (33, 72) in a ring shaped structure (preferably circular) to distribute and resist compression forces.

Preferably, the guideway track (50) comprises one, or two opposing, elongate bearing panel element(s) (56, 90) internally protruding from an internal surface (52) thereof, each having an elongate bearing face (58, 98) angled in a direction to resist lateral extraction forces, optionally in which the bearing panel element(s) is generally, or substantially, triangular in cross-section. Preferably, the guideway tube further comprises a bearing panel insert (90), for providing an extended bearing panel face (98) inwardly projecting into volume V1.

Preferably, the guideway track (50) comprises one or more elongate shear key elements (54) on an external surface thereof. Preferably the elongate shear key elements (54) are of trapezoidal cross-section increasing in diameter along a radius from a centre of guideway track (50).

Preferably, the closure panel (70) is connected to the guideway track (50) by a frangible attachment mechanism (80) (such as tacking pins, screws, adhesive, glue or the like or any other fastening of low mechanical strength).

Preferably, the guideway track (50) is made of material of relatively higher mechanical strength and the closure panel (70) is made of material of lower mechanical strength with respect to the guideway track 50. Preferably, the guideway track (50) is made of Glass Fibre Reinforced Plastic (GRFP), optionally having both longitudinally and laterally laid fibres therein, preferably in proportion of about 50:50 or 60:40 or 40:60 or 70:30 or 30:70 thereabouts. Preferably, the closure panel is made of plastic, or is made of Glass Fibre Reinforced Plastic (GRFP), optionally, having, only longitudinally positioned fibres therein.

Preferably, the closure panel is formed from a plurality of inter-engaging closure panel sections. Preferably the closure panel sections are of predetermined length (i.e. length along a height of an end face of a panel). Preferably, the closure panel sections are discrete. Optionally, these are weakly frangibly connected to one another e.g. with lines of weakness or perforations in the manner of sections of paper towel on a roll). Preferably, a seal (71) is provided between neighbouring closure panel sections. Inter-engaging features from one closure panel section to the next along a height of the guideway tube may be provided and may simply be cooperating opposing generally, or substantially, planar faces, the planar faces preferably being generally, or substantially, perpendicular to a longitudinal direction along the closure panel. Alternatively or in addition, a seal such as a paper, plastic or rubber gasket or such like is used between neighbouring closure panel sections.

In a further aspect, there is provided an apparatus comprising:—a guideway tube (32) according to the invention; at least one water-stop locator member (101, 102), and; a continuous elongate water stop (100) for positioning near or adjacent the elongate slot (44) (e.g. near or adjacent the extended elongate slot (144)) along a height of the guideway track (50).

Preferably, the guideway track (50) comprises two elongate wings (60) each extending externally from the at least one side wall (33) adjacent elongate slot (44) to form an extended elongate slot (144) and, the at least one water-stop locator element comprises at least one elongate carriage member (101, 101A, 101B, 101C, 101D, 101E) configured to engage (e.g. by push-fitting onto, snap-fitting onto and/or travelling slidably along) one or more of the wing members (60) to locate the water-stop (100) near or adjacent the elongate slot (44), or the extended elongate slot (144), along a height of the guideway track. In this way wings (60) of guideway track (50) act as track(s) or rail(s) along which water-stop locator elements can travel and be located.

Preferably, the carriage member (101) is one or more of:—i) one-sided, ii) elongate (e.g. along the height of the guideway tube) iii) continuous, iv) flexible, v) resilient vi) snap-fitted to wing(s) (60), vii) push-fitted to wing(s) (60), viii) slidable on wing(s) 60.

Preferably, one or both wings 60 comprise at least one of an inwardly projecting profiled (preferably rounded) rear distal edge (162A), an outwardly projecting profiled (preferably rounded) front distal edge (162B) and the water stop locator element (201) comprises at least one of a corresponding rear grip element (208A) and a front grip element (208B) sized and shaped to engage and travel along a respective front or rear distal edge(s) (162A, 162B).

Preferably, the elongate carriage member (101) is connected to the one wing (60) by one or more of adhesive, Velcro, a snap-fit mechanism (e.g. a clip), a push-fit mechanism, inter-engaging features. Preferably, the, preferably elongate, carriage member, is made of sufficiently flexible material e.g. extruded flexible plastic, e.g. PVC, polypropylene or suitable plastics, to be wound about a spindle e.g. for storage prior to deployment. Preferably, the water-stop locator element comprises a plurality of two sided (i.e. supported on both wings 60) discrete locator elements (102) spaced apart along one (or two laterally spaced) water-stop elements 100, and, optionally, the discrete locator elements (102) comprise slidable (continuous or discrete) members for sliding along the wings of the guideway track, to a desired location. These may be quite short in a vertical direction when discrete (see FIG. 31). However where elongate carriage members are provided these may be quite tall along the height of the tube and are continuous over their height.

In a further aspect there is provided, a guideway track for use in a guideway tube of the invention, or in apparatus of the invention, or in a method of the invention, comprising:— at least one elongate side wall (33) and an elongate slot (44) along the at least one elongate side wall (33), the elongate slot (44) having a first width (W1); and, one, or preferably, two elongate wings (60) each extending externally from the at least one side wall (33) adjacent respective free end faces of elongate slot (44) to form an extended elongate slot (144).

In a further aspect there is provided, a method of constructing a diaphragm wall comprising:—providing a guideway tube (32) according to the invention or an apparatus according to the invention; casting the guideway tube (32) into a first concrete panel (24) along a height of an end face of the panel (24); optionally, cutting along the height of the end face of the panel (24) or optionally removing a stop end former from the height of an end face of the panel (24); separating (preferably by pushing-out e.g. laterally) the closure panel (70) from the guideway track (50), and breaking any frangible connections (80) between these, where provided, so as to open slot (44,144) exposing the internal volume V1 of the guideway track (50) optionally installing e.g. by lowering an enlarged end of a tension connector 150A along the slot into the guideway track 50; pouring a second concrete panel (26), so that concrete enters the internal volume (V1) of guideway track (50). Preferably, the steps of cutting the panel and of separating (e.g. pushing-out) the closure panel 70 from the guideway track 50 are undertaken in the same 'pass' (preferably the same descent) of a milling machine such as that shown in FIG. 1.

Preferably, the method comprises installing an elongate water-stop (100) (preferably a continuous elongate water-stop e.g. of same height as the wall) and positioning same near or adjacent the elongate slot (44), or the extended elongate slot (144) where provided, of guideway track (50) (e.g. near a free edge of the side wall 33) along a height of the guideway track (50).

Preferably, the method comprises installing a water-stop locator member (101, 102) and water-stop (100) by sliding the water-stop locator member (101, 102) along free edges, or wings (60) or free rear and front distal edges (162A, 162B) of wings (60) where provided, of the guideway track (50) along the height of the concrete panel; and/or, installing a water-stop locator member (101, 102) and water-stop (100) by affixing, the water-stop locator member (101, 102) (e.g. by push-fitting, snap-fitting, friction fitting, adhesive bonding, Velcro bonding, clipping resiliently) to the free edges, or to the wing(s) (60) or free rear and front distal edges (162A, 162B) of wings (60) where provided, of the guideway track (50) along the height of the concrete panel.

Preferably, the method comprises drilling one or more, generally or substantially, horizontal bore(s) into the concrete panel (24), the bore(s) engaging the water-stop (100) near or adjacent the slot (44, 144) of the guideway tube (32); filling the bore with water-stop material (e.g. hydrophilic and/or injectable water-stop material). This provides a double element water-stop arrangement with intersecting vertical and horizontal water-stop elements, each, in this case, elongate or linear water-stop elements.

Preferably, the method comprises installing a two-dimensional sheet of waterproof, water-resistant or water-stop material against a face of a concrete panel, the sheet engaging with the horizontal water-stop. This provides a triple element water-stop arrangement, with intersecting vertical and horizontal water-stops, and intersection between a horizontal water-stop and a sheet (also known as a panel) of water-proof or water resistant material.

In a further aspect the invention provides a kit comprising one or more if apparatus according to the invention, at least one water-stop locator element (101, 102, 201), at least one water-stop (100).

In a further aspect the invention provides a concrete wall such as a diaphragm wall comprising a guideway tube (32) according to the invention and/or apparatus according to the invention and/or a guideway track (5) according to the invention, and/or formed by a method according to the invention.

The wall may comprise two or more panels or all panels of rectangular cross-section or may comprises at least one of panel of circular cross-section and at least one panel of rectangular cross-section or all panels of either rectangular or circular cross-section or may comprise all panels of circular cross-section.

BRIEF DESCRIPTION OF THE DRAWINGS

The present invention will now be described by way of example only, with reference to the following Figures. In this document like referenced numerals refer to like features and reference numerals are used for purposes of illustration of example embodiments and are not considered to be limiting.

FIG. 6 shows a plan, cross-sectional view of two, laterally spaced guideway tubes embedded in a first concrete panel.

FIG. 7 shows the guideway tubes of FIG. 6 after milling of the end face of the first concrete panel.

FIG. 8 shows a plan, cross-sectional view of a guideway track.

FIG. 9 shows a plan, cross-sectional view of a corresponding closure panel for the guideway track of FIG. 8.

DETAILED DESCRIPTION OF THE INVENTION

In the previous and following descriptions, diaphragm walls are referred to, for ease of reference, as a particularly suitable example of the application of the invention. Nevertheless, it is to be understood that various concrete embedded retaining walls such as diaphragm walls, slurry walls, contiguous pile walls, and secant pile walls and the like may also be constructed using the principles of the invention requiring a joint between two panels and the term diaphragm wall is to be understood to include such other walls and piles unless the context requires otherwise. Concrete is referred to throughout for clarity and simplicity, but it will be well understood that the invention applies to any flowable, hardenable material.

Furthermore the previous and following descriptions refer to panels that are typically planar and rectangular in cross-section, having two generally planar, substantially parallel, wider, "side" faces and two generally planar, substantially parallel, narrower, "end" faces. However, it is to be understood the invention may be used with other shaped panels such as "panels" of circular or other (e.g. hexagonal) cross-sections such as piles. Whilst the apparatus and methods of the invention are particularly described herein in relation to "end" faces (also known as "end" walls) of generally rectangular concrete panels, it is to be understood that the apparatus and methods of the invention can be used in relation to "side" faces (also known as "side" walls) of a rectangular panel, "end" and/or "side" faces (also known as "end" and/or "side" walls) of a rectangular panel or indeed faces (also known as walls) of another shaped "panel" such as a circular "panel". The term "panel" should be interpreted to include these various embodiments except where the context determines otherwise.

The first panel and the second panel are typically rectangular in cross-section, although a bored pile of differing (typically circular or square) cross-section may be used as a 'panel' within the context of the invention. Typically a narrow soil column may be left in between the first panel 24 and the newly excavated trench 26 for forming a second panel.

It will be understood by those skilled in the art that any dimensions, or any directions such as vertical or horizontal, referred to in this application are within expected construction tolerances and limits for building diaphragm walls and these terms should be construed with this in mind.

Figure 1:
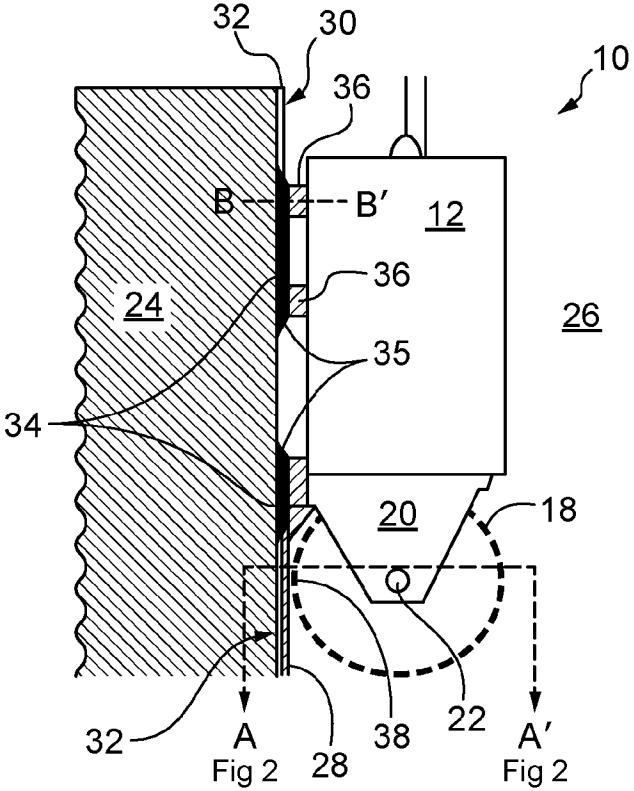
FIG. 1 shows a side, cross-sectional elevation of a milling apparatus for milling an end face of a concrete panel.

In FIG. 1, first concrete panel 24 has an end face 28 that is approximately vertical over its length. This verticality is determined by a first cutting machine, typically a grab, used to excavate the trench for the first panel. Similarly the verticality of the walls of the second excavated trench may be determined by the cutting machine, typically an existing grab, used to excavate it. Prior art grabs (not shown) are guided by gravity and may be subject to sideways movement during excavation due to the ground it encounters. The end face 28 of first panel 24 may therefore deviate from vertical. WO2013/007968 COUPLAND uses a guideway tube and guide to hold a milling apparatus adjacent to the end face of the first panel regardless of its verticality. The present invention provides improved apparatus and methods using guideway tube(s) for this purpose and other purposes and for installation of water-stop arrangements.

Figure 2:
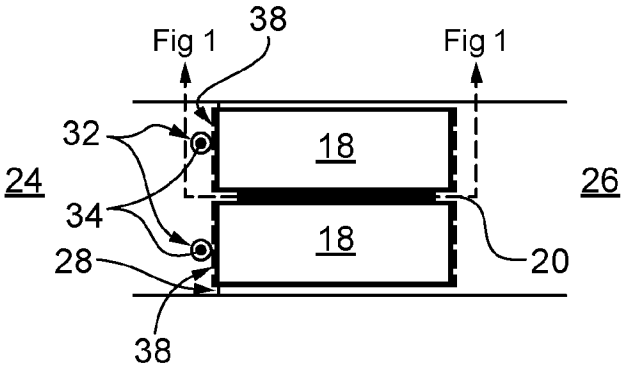
FIG. 2 shows a plan, cross-sectional view of the milling apparatus of FIG. 1 along line AA'.

FIGS. 1 and 2 show elevation and plan cross-sectional views of a milling machine 10 having a main body 12 and a pair of laterally spaced milling wheels 18 on a wheel support 20 mounted on axle 22. Milling machine 10 is shown adjacent end face 28 of a first concrete panel 24. Once dug, the second panel 26 is typically filled with slurry such as bentonite slurry to prevent its collapse. A guideway tube 32 has been embedded in first concrete panel 24 adjacent end face 28. The guideway tube 32 comprises at least one side wall 33 extending vertically along the end face 28, and an elongate opening or slot 44, closed by a closure panel 70 (see FIGS. 4 to 14).

Milling machine 10 typically has spaced guides 34, typically four or more guides 34 are provided in laterally spaced pairs, each laterally spaced pair being spaced vertically from the next pair. The guides 34 are mounted on guide supports 36 to main body 12. Guide supports 36 may be hingedly connected via hinges 37 (see FIG. 3), e.g. pin joint(s), to main body 12 or indeed to wheel support 20. Mill teeth 38 on mill wheels 18 are typically located below guides 34 and are used to mill end face 28 of first concrete panel 24, typically on a downward pass of milling machine 10, so opening guideway tube(s) 32 for guides 34 on guide supports 36 to travel in the now open guideway tube 32 holding milling machine 10 to end face 28 and resisting lateral horizontal forces away from the end face 28.

Guideway tube 32 is concreted into panel 24 adjacent end face 28. Guideway tube 32 is typically hollow and sealed at its base to prevent ingress of slurry or concrete until it is opened, in this invention by pushing out of closure panel 70 from elongate opening or slot 44, as will be described later. End face 28 is cut way by the action of the milling machine 10 to form a milled end face 30 of panel 24. The milling machine 10 prepares the milled end face 30 ready for a joint with a neighbouring panel which is poured later. Guides 34 (and guide supports 36) of milling machine 10 push out closure panel 70 and break any remaining concrete or soil in front of guideway tube 32, opening up slot 44. Alternatively, as will be described later, a stop end former may be used to form a shaped end of a first panel 24 containing a guideway tube 32 and, following removal of the stop end former, a ram, wedge or lance may be used to open guideway tube 32 by pushing or levering out the closure panel 70, breaking any remaining concrete or soil in front of guideway tube 32 and opening up slot 44.

One or more guideway tubes may be provided. Indeed, end face 28 of first panel 24 may be provided with two laterally spaced guideway tubes 32 as shown in FIG. 2. Where two or more guideway tubes are provided these are typically laterally spaced so as to provide a guiding action to mill 10 over a lateral extent of end face 28 of panel 24. Two guides 34 may be provided and these may be vertically and/or horizontally spaced from one another (in use) and at least one guide may be hingedly connected to the mill body 12.

Figure 3:
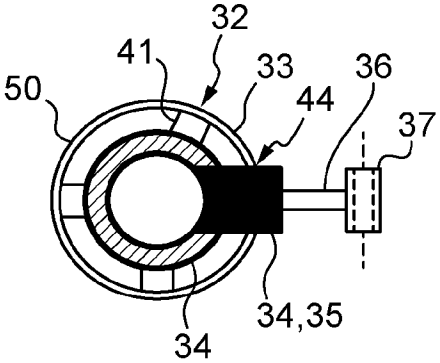
FIG. 3 shows a plan, cross-sectional view of a guide and guideway tube of FIG. 1 along line BB', after pushing out of closure panel (70) (not shown).

FIG. 3 shows a cross-section through a guideway tube 32, guide 34, and a guide support 36. One or more, and typically three or four, elongate bearing strips 41 may be provided, spaced circumferentially around guide 34 and fixed to it. These may be made of a low friction material such as plastic or PTFE and facilitate the motion of guide 34 within guideway tube 32. Guide 34 has upper and lower angled guide profiles 35, at upper most and lower most positions thereof, the purpose of which will be described later. The angled guide profiles 35 are preferably wedge-shaped with the thin end of the wedge(s) pointing down along guideway tube 32 or upwards along guideway tube 32 as seen best in FIG. 1.

Figure 14:
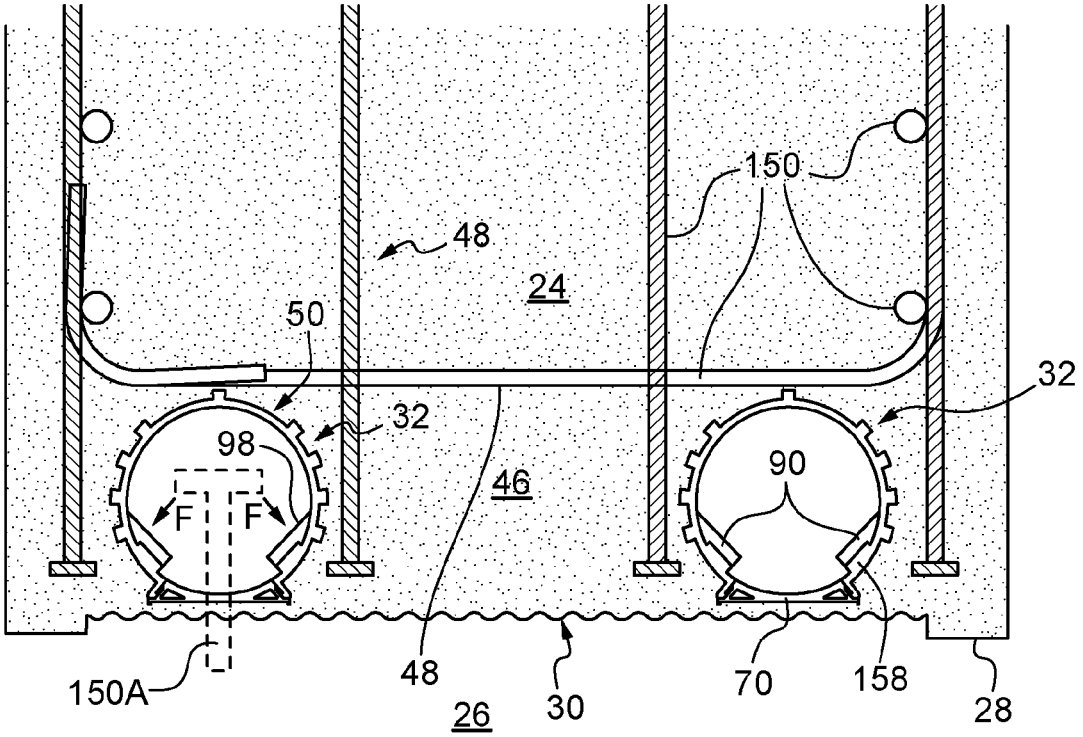
FIG. 14 shows a plan, cross-sectional view of laterally spaced guideway tubes connected to reinforcement in a first concrete panel.

Referring briefly to FIG. 14, whether or not a tension connection between adjacent panels is provided (see WO2013/007968 COUPLAND for details), a reinforcement cage 48 can be used to carry (and assist in lowering) guideway tube(s) 32 at one or both ends of cage 48. Cage 48 is made from bars 150, such as steel bars, in a suitable arrangement and density for the size and shape of the trench and the desired diaphragm wall purpose and expected loads. The guideway tube(s) 32 may be lowered separately along the height of the end face of a slurry filled trench, but, if a reinforcement cage is to be used, it is convenient to attach it to the reinforcement cage and lower the guideway tube(s) 32 along with it.

Slurry (not shown) is displaced from a first trench (not labelled) by introducing concrete 46 into the bottom of the first trench. The guideway tube 32 is now concreted into first panel 24 adjacent end face 28.

A second panel trench (not shown) is dug adjacent end face 28 of first concrete panel 24. The second trench is filled with slurry to prevent its collapse. Due to the depth of the trench, and the variation in verticality of both the end face 28 of the first panel 24 and the end of the second trench, a narrow soil column of varying width may be left adjacent the end face 28 of first concrete panel 24 and the end of second slurry filled trench. The width of the remaining soil column, if any, is probably less than 0.5 m, for example 100-300 mm.

Milling machine 10, is used to cut along the length of the end face 28 and along the end of second trench so as to join these together. The guide(s) 34 are slotted into the guideway tube 32 and guide the position of the cutting zone of cutting wheel(s) 18 with respect to the end face 28 of first concrete panel 24. Furthermore, the guide(s) 34 are arranged with respect to the guideway tube 32 so the closure panel 70, which is preferably of a wedge-shaped cross-section, is pushed out and away from the guideway track 50 by the action of angled guide profiles 35 (where provided), opening up the guideway tube 32 along its length allowing ingress of slurry into guideway track 50. The closure panel 70 is preferably in short sections, so these fall away individually from the end face 28 to the bottom of the trench for later recovery.

Alternatively, as will be explained later, if a stop end former is used, this is peeled off the end face of the first panel 24, prior to levering away closure panel 70 any remaining concrete in front of guideway tube 32 and opening up slot 44.

Thus a pre-prepared, pre-defined elongate slot or opening 44 is opened up along the length of the guideway tube 32 about a portion of its periphery (in a direction perpendicular to its length) and along its length, in between the wings 60 of the guideway track 50 where these are provided. Furthermore, the peripheral wall of the guideway track 50 and the guide 34 are of co-operating sizes so that the guide 34 is retained in the guideway track during cutting e.g. milling. Thus, the guide 34 acts as an anchor in the guideway track resisting sideways movement of the milling machine 10 away from the end face 28.

A prepared end face 30 of first concrete panel 24 is provided by the cutting action of milling machine 10 vertically along end face 28. This prepared end face 30 forms a clean, well defined, accurately positioned surface with which to form a joint with the neighbouring panel 26. Alternatively, or in addition, when a ram, wedge or lance is used to open the guideway tube 32 and remove any remaining concrete left e.g. after a stop end former is removed, the prepared end face will adopt the shape of the stop end former which has been peeled away.

The internal volume of the guideway track is in fluid communication with the second panel trench so that when concrete for the second panel is poured (not shown) it fills the guideway track 50 concreted into the first panel thereby providing inter-engaging keying features between the neighbouring panels 24, 26 forming a construction joint. Should a strong shear key between first and second panels be required, milling wheels 18 of milling machine 10 can be set to cut a deeper, wider shear key recess 84 to one side of a guideway track. Where a stop end former is used, this may be used to form such a deeper, wider shear key recess 84 (see FIG. 7).

Figure 4:
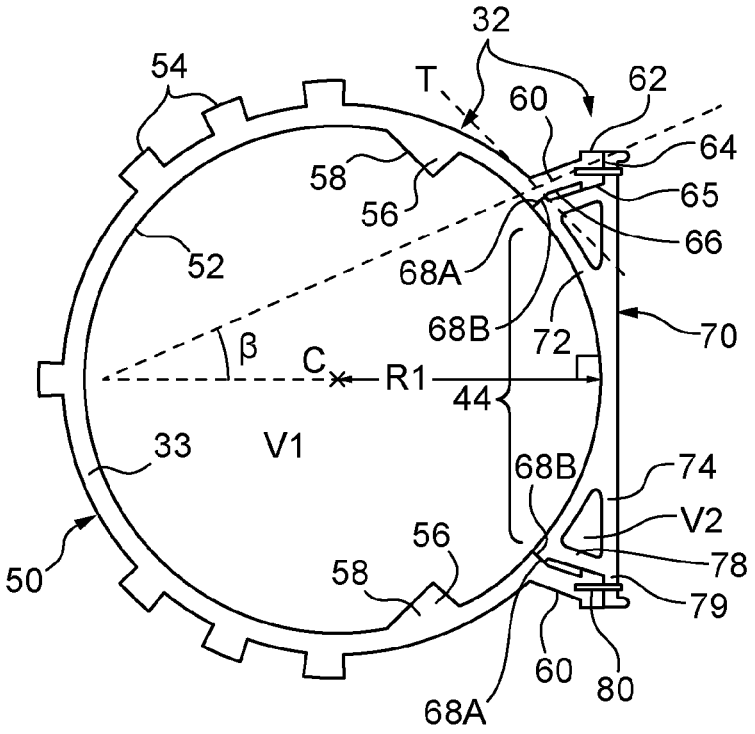
FIG. 4 shows a plan, cross-sectional view of a guideway tube comprising a guideway track and closure panel according to one aspect of the invention.

FIG. 4 shows the improved version of guideway tube 32 in more detail comprising a guideway track 50 having upstanding (or outwardly extending) angled wings 60 and incorporating a closure panel 70. Guideway track 50 comprises, in this example, a continuous side wall 33 which is circular in cross-section with an elongate slot or opening 44 at one side. Depending from each elongate free edge of the side wall 33 defining this opening 44 are angled wings 60. Angled wings 60 are not aligned with a radius of guideway track 50, although they may be. A particular radius extending from the centre of circular guideway track 50 to the centre of the opening 44 is labelled R1. The angled wings 60 are preferably not parallel to, nor are perpendicular to, this radius R1 but rather are at an acute angle "β" to it. Typically, angled wings 60 are at an angle with respect to a tangent "T" formed at the base of each angled wing 60 on the circumference of circular side wall 33. Angled wings(s) 60 may be perpendicular to tangent "T" (in which case angle β is around 45° or β may be around 5°-85° or more preferably 15°-75°). Thus angled wings 60 form a wedge shape cross-section (extended elongate slot 144) within which a co-operating closure panel 70 of corresponding wedge shaped cross-section can be located.

The side wall 33 of guideway track 50 comprises a number of elongate shear key elements 54 protruding externally from it to resist lateral extraction from the concrete. The internal surface 52 of side wall 33 of guideway track 50 is provided with two opposing, inwardly protruding, elongate bearing panel elements 56 (here of generally triangular cross-section). Each bearing panel element 56 is provided with a first bearing face 58 at a preferred acute angle "α" with respect to a radius as shown more clearly in FIG. 8. Preferably angle "α" is 45° approximately.

Referring again to FIG. 4, each angled wing 60 has an enlarged distal end 62, preferably provided with locating elements such as front face 64 and a side face 65. The enlarged distal end 62 is provided by an elongate side wall recess 66 in wing 60. Guideway track 50 is also provided with first bearing face(s) 68A contiguous and in line with the ring, here a circular ring, and are formed by edge faces of side wall 33 defining opening 44. Closure panel 70 has co-operating second bearing face(s) 68B opposing first bearing face(s) 68A and which bear upon first bearing surfaces 68A when these are in contact with one another to complete the profiled peripheral wall (33, 72) (preferably a ring-shaped profile, more preferably a circular, ring-shaped profile) formed by guideway track 50 and closure panel 70, thus enclosing internal volume V1. Importantly, the completed ring-shaped structure (33, 72) distributes and resists the external compression forces about the internal volume. It is therefore preferred that the opposing first and second bearing surfaces 68A and 68B are sized, shaped, and positioned to co-operate. Preferably, these bearing surfaces 68A and 68B lie substantially along radii of the circular ring of guideway track 50.

Closure panel 70 typically has a front panel 74 which is preferably planer for simplicity and also preferably comprises an angled side wall 78 which co-operates with front panel 74 and rear panel 72 to provide a generally wedge-shaped cross-section symmetrical about a central line of symmetry. Thus, closure panel 70 has a generally wedge shaped cross-section which co-operates with the generally wedge-shaped cross-section of the extended elongate slot 144 between the angled wings 60 of guideway track 50. These wedge shaped cross-sections are well-defined in shape and position with respect to one another, so that, when the closure panel 70 is removed (e.g. by the action of guide 34 or a ram, lance or wedge) the remaining angled wings 60 of the guideway track provide well formed "rails" and are in well-defined positions (although their precise positions may vary).

As can be seen in FIG. 9, front panel 74 has side extensions 79 which co-operate with side walls 78 to form corner recess(es) 77, which, in turn, co-operate with exposed corner, front, and side faces 64 and 65 of angled wings 60 locating neatly on one another. Furthermore, side walls 78 have an outer elongate recess 76 generally opposing recess 66 of angled wing(s) 60 facilitating location and positioning of co-operating first and second bearing surfaces 68A and 68B, and preferably also exposed corner, front and side faces 64 and 65 with the corner recess 77. A volume V2 is preferably enclosed by rear panel 72, front panel 74, and side wall 78. This triangular box cross-section facilitates strength and lightness of closure panel 70.

The ring-shaped structure provided by side wall 33 of guideway track 50 and rear panel 72 of closure panel 70 may be alternative shapes such as curved, parabolic, oval, square, rectangular, triangular etc. However, it is preferred that at least the rear panel 72 of closure panel 70 is curved e.g. circular, rather than planer, to better resist compression forces upon guideway tube 32 when embedded in slurry or concrete. Preferably, the cross-section of guideway track 50 and rear panel 72 are both curved and, more preferably, circular and of the same radius.

Fastener(s) 80 of low mechanical strength (such as tacking pins, adhesive and the like) are conveniently provided between the distal end 62 of wing 60 and side extension(s) 79 in a suitable distribution and/or number to hold closure panel 70 in position on guideway track 50 when there are no or insufficient compression forces from surrounding liquid to hold this in place (e.g. during manufacture and transport). Typically, guideway tube 32 is filled with slurry and it is lowered into a trench, so the fastener 80 must be of sufficient strength to resist any lateral forces from disparity between the levels of slurry inside and outside the guideway tube e.g. during installation.

Guideway track 50 is preferably made from glass fibre reinforced plastic (GFRP). Guideway track 50 may be pull-truded with requisite glass fibres in place as would be understood by those skilled in the art. These fibres may be longitudinal i.e. along the length of the guideway track 50, and may also be transverse i.e. perpendicular to the longitudinal dimension of the guideway track 50. Indeed, fibre in the form of mesh may be used within guideway track 50. In this way guideway track 50 may have mechanical strength of around 300 MPa or over in a longitudinal direction and around 150-200 MPa in the transverse direction. Closure panel 70 may also be made from GFRP, although it has no need of particular strength and may be made of plastic or other sacrificial material. Where this is made of GFRP there is no need for transverse strength to be provided and so closure panel 70 may simply be pull-truded with longitudinal fibres. Closure panel 70 is a sacrificial element as it is pushed out from its position closing guideway track 50, e.g. by guide 34 during descent of mill 10, or during descent of a ram, lance or wedge. Preferably closure panel 70 is recovered from the second trench before concreting e.g. with a grab.

Indeed, closure panel 70, when in place along the guideway track 50, is continuous in a longitudinal direction (vertical when in place in a trench) providing an elongate guideway tube 32. However, closure panel 70 may be formed in individual sections, each tacked by one or more frangible fasteners 80 one after the other along, in between, continuous angled wings 60. Preferably, closure panel 70 is provided in multiple elongate sections of around 0.5 m, 1 m, 1.5 m, or 2 m in length. Between these closure panel sections, a seal 71 such as a rubber gasket, paper gasket, glue or the like, may be provided (see FIG. 9 for possible location of a seal) to prevent any substantial ingress of concrete via the point between neighbouring closure panel sections. Indeed, additional fastenings between one elongate section and the next (not shown) may be provided. The closure panel sections may be manufactured off site as a single unit, optionally wound about a spool, and cut into desired lengths on site.

Figure 5:
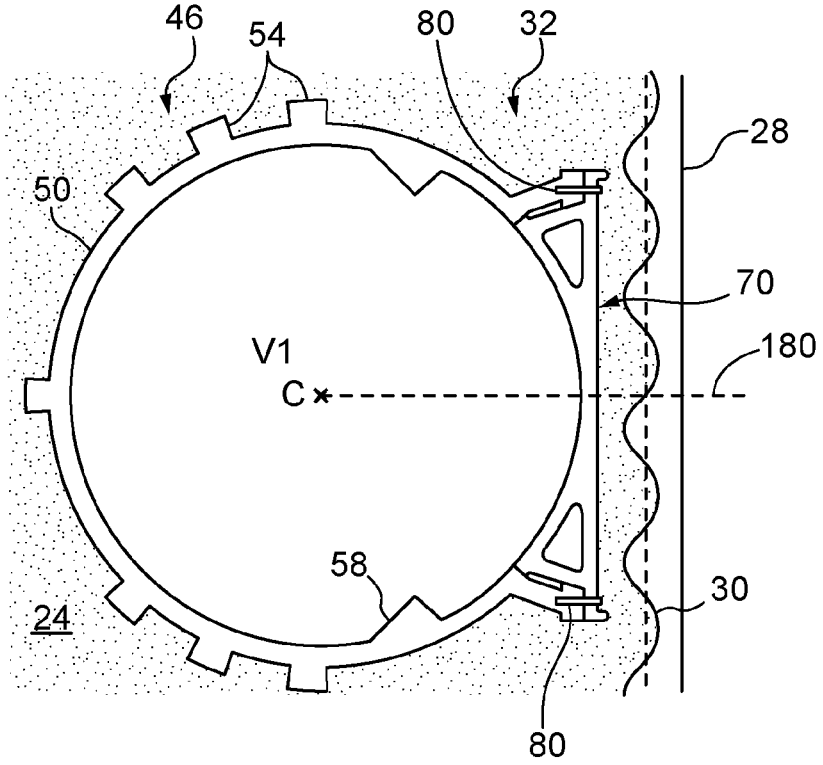
FIG. 5 shows the guideway tube of FIG. 4 embedded in a first concrete panel.

In FIG. 5, guideway tube 32 comprising guideway track 50 and closure panel 70 are encased in concrete 46 within first panel 24. Closure panel 70 may be held in place by a friction fit arrangement and/or is held in place by frangible fasteners 80. Fasteners 80 can be used to hold individual closure panel sections in place one after the other, along continuous guideway track 50 until firstly slurry and later concrete, and associated external compression forces acting about guideway tube 32 assist in, holding these in place.

An end face 28 of concrete panel 24 is shown. A prepared end face 30 following milling is also shown. Alternatively, a prepared end face may be provided by peeling off a stop end former (not shown). There may be some variation in the depth of the milled cut behind the original end face 28 and a certain amount of concrete (and soil) may remain in front of closure panel 70. This can be broken by guide(s) 34 and guide supports 36 and, in particular, angled guide profile(s) 35 at the lowermost ends of guides 34 (or indeed by a ram, lance or wedge, optionally a vibrating ram, lance or wedge). The angled guide profiles 35 assist in the locating of, and passage through of, guide(s) 34 in guideway tube 32. During descent of mill 10, the guide(s) (or ram, lance or wedge), and angled guide profile(s) 35, where provided, push out wedge-shaped closure panel 70 (or closure panel sections—not shown) from guideway track 50 (and any remaining concrete in front of it) to open volume V1 to the ingress of first bentonite slurry and, later, concrete.

If closure panel 70 is provided in individual closure panel sections (not shown), as guide 34 (or a ram, lance or wedge) travels down guideway tube 50, angled guide profile(s) 35 engage each individual closure panel sections 70 one at a time, and push these laterally outwards individually away from guideway track 50, breaking fastener(s) 80 as the guide progresses. Each individual closure panel 70 is released from its position, lightly attached to guideway track 50, one (say 1 m) section at a time, and these section(s) fall to the bottom of the second trench for later recovery if required. The individual closure panel sections 70 may be frangibly connected to each other along the guideway track 50, or not, or a continuous closure panel 70 may be used. However, in either case, preferably closure panel 70 is made of sacrificial materials such as plastic or GFRP with just a few fibres.

Inwardly protruding bearing panel elements 56 have (preferably two opposing) first bearing faces 58 which may be used for engaging corresponding bearing surfaces on guide 34 (not shown). Alternatively, or in addition, as shown in FIG. 3, one or more and preferably several bearing strips 41 may be provided within guideway track 35 either on guide 34 or the innermost surface 52 of guideway track 50 to facilitate guide travel.

Referring to FIGS. 6 and 7, an end face 28 and a prepared end face 30 (here after milling, but it could be after peeling off a stop end former) of a first panel 24 are shown adjacent two laterally spaced guideway tubes 32 comprising guideway tracks 50 and respective closure panels 70. Some example dimensions are also shown. In FIG. 7, an optional cut line 82 is shown, which may be milled out by milling machine 10 to provide an optional shear key recess 84 that provides a shear key construction joint between panel 24 and second panel 26, once second panel 26 is poured. Whilst some resistance to shear is provided by concrete entering guideway tracks 50, this is relatively weak and further shear key features such as recess 84 may be required.

FIGS. 8 and 9 show guideway track 50 and co-operating closure panel 70 in more detail. Bearing panel elements 56 each have a first bearing face 58 at an angle of, preferably, 45° to a radius "R" (parallel with slot 44) with the centre. Two opposing bearing panel elements 56 are provided longitudinally along internal surface 52, off-set from the centre, to form a narrowing (not labelled) of width W3. Opposing bearing surfaces 68A at the base of angled wings 60 also provide a narrowing of predetermined width W1 forming the base of elongate slot 44. Rear panel 74 of closure panel 70 has a greater width W2, greater than width W1 of slot 44, so that it cannot (easily or without significant deformation) be pushed into the internal volume V1 of guideway track 50. Closure panel 70 has a rear panel 72 provided at each end with bearing surfaces 68B for co-operating with bearing surfaces 68A of side wall 33 of guideway track 50.

Closure panel side walls 78 have a recess 76 terminating at front wall panel side extensions 79, and optional front protrusions 81 (to facilitate ease of handling). When closure panel 70 is located within the extended elongate opening 144 between angled wings 60 it is prevented from passing further inwards both by second bearing surfaces 68B acting on first bearing surfaces 68A, by width W2 of front panel 74 and by optional front panel side extensions 79. Furthermore, recesses 76 ensure that bearing surfaces 68B stand proud of side walls 78 facilitating engagement with co-operating bearing surfaces 68A of angled side walls 60. Outer width W2 of front panel 74 is greater than inner width W1 of slot 44.

Figure 10:
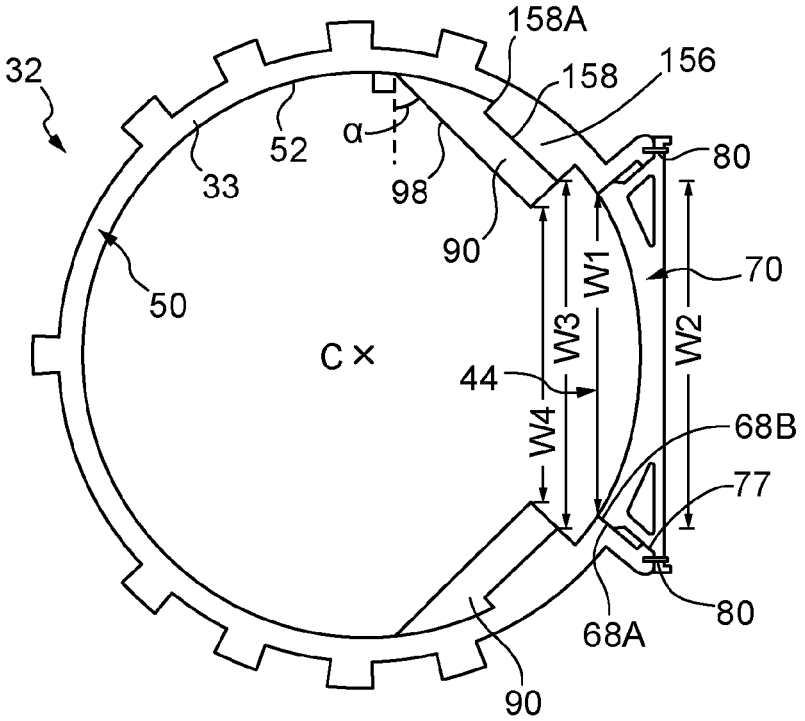
FIG. 10 shows a plan, cross-sectional view of an alternative guideway tube (comprising a guideway track and a closure panel) particularly suitable for a tension connection, in a further aspect of the invention.

FIG. 10 shows a further variation in which a bearing panel insert 90 is used to provide at least one and preferably two opposing, extended bearing surface(s) 98 within guideway track 50. Here an internal inwardly extending protrusion 156 has a connecting surface 158 with a keying recess 158A upon which insert 90 (and its cooperating recess 99) can be fixed, preferably by gluing. This preferably takes place during off-site manufacture. Extended bearing surface 98 is provided at an angle $\alpha$ to a line parallel to a radius of guideway track 50. The separation of the extended bearing surfaces 98 is labelled W4 and this bearing panel separation W4 is of the same or similar width W1 as opening 44 or, more preferably, narrower (i.e. W4<W1).

Figure 11:
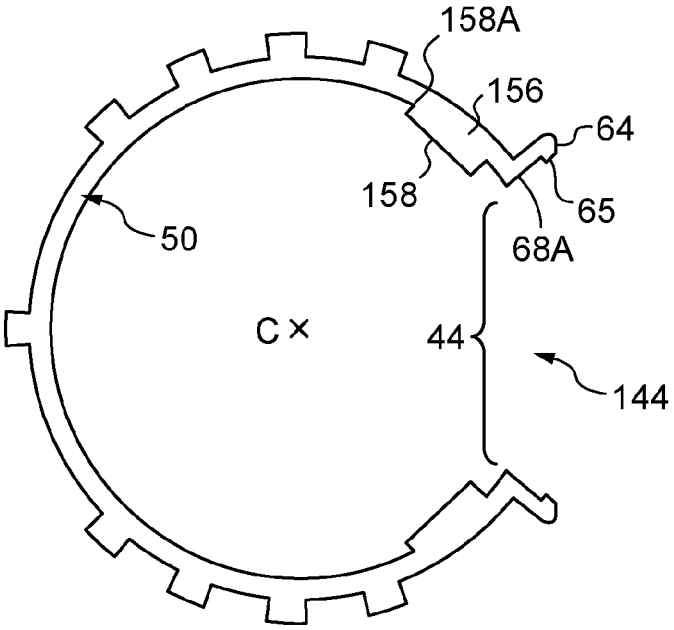
FIGS. 11, 12 and 13 show plan, cross-sectional views of the components of the guideway tube of FIG. 10, respectively a guideway track (FIG. 11), a closure panel (FIG. 12), and bearing panel insert (FIG. 13).
Figure 12:
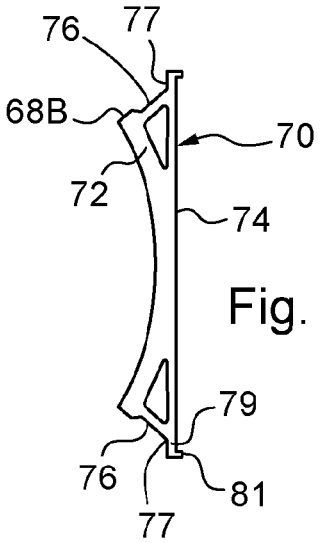
Figure 13:
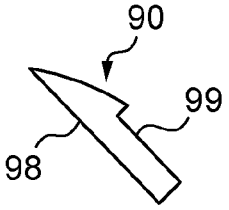
Figure 15:
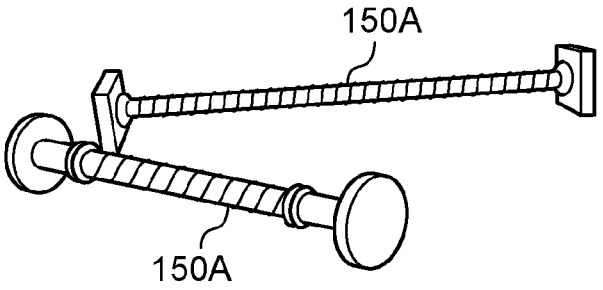
FIG. 15 shows perspective views of example tension connectors e.g. for use with the guideway tubes of FIGS. 10 to 14 or of FIGS. 32 to 37.

FIGS. 11, 12, and 13 show the guideway track 50, closure panel 70 and insert 90 in more detail. Guideway tube 32 with insert 90, or with integral extended bearing surfaces 158 (see FIGS. 32 and 34), is of particular use when tension connections are provided as shown in FIGS. 14 and 15. Here a reinforcement cage 48 is provided by various iron or steel bars 150 in a variety of arrangements. Tension bars 150A of a reinforcement cage of a second panel (not shown) may be lowered within guideway track 50 of a first panel 24 following removal of closure panel 70. Tension bars 150A need not contact bearing surface 98 (or 158) but, as can be shown by arrows F, a tension connection can be provided by the action of tension bar 150A embedded in concrete of a second panel 26 upon bearing surfaces 98 (or 158) of guideway track 50 and connected to a reinforcement cage (or simply embedded) in a second panel 26.

Figure 16:
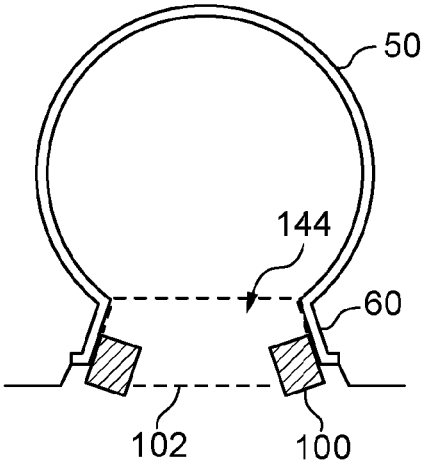
FIG. 16 shows a plan, cross-sectional view of a guideway track with two, spaced, elongate water-stops in position adjacent distal free edges (also known as distal ends) of the wings of the guideway track, according to a further aspect of the invention.

FIG. 16 shows a further aspect to the invention in which one or more continuous, vertical (or generally or substantially vertical) water-stop(s) 100 may be provided adjacent to slot 44 (or extended slot 144), and in particular preferably mounted on angled wings 60 of guideway track 50. Preferably these are located within or adjacent the (here) extended wedge-shaped slot 144 falling between angled wings 60. This is the region most likely to suffer stress and cracking between panels 24 and 26 allowing water seepage.

Figure 17:
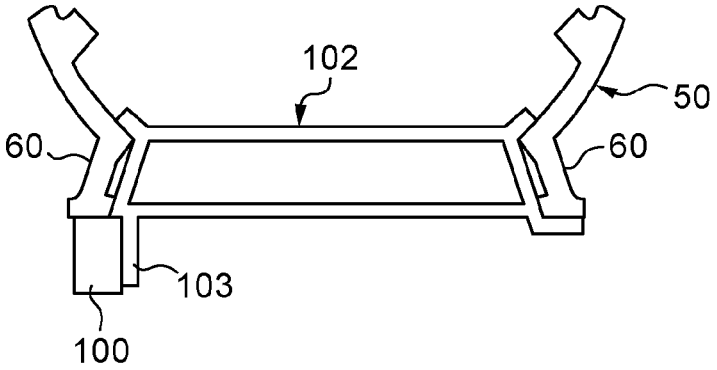
FIG. 17 shows a plan, cross-sectional view of a double-sided water-stop locator element (here a wide plastic clip) for inserting between the wings of a guideway track at spaced (vertical) intervals to deliver a (vertical, continuous) water-stop at the distal end of one of the wings of the guideway track, preferably on the side closest to the exposed face of the concrete panel.
Figure 18:
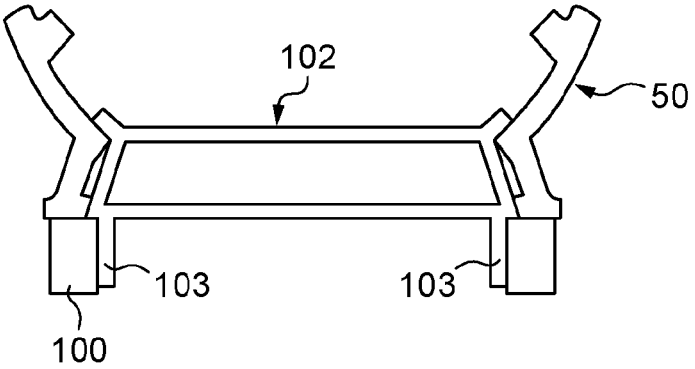
FIG. 18 is similar to FIG. 17 save that two (vertical, continuous) water-stops are provided, one at a distal end of each wing of the guideway track.

FIG. 17 shows a water-stop locator element in the form of a double-sided plastic clip 102 (a double-sided discrete water-stop locator element). Indeed several plastic clips 102 are provided spaced apart along a continuous water-stop element 100. Water-stop elements 100 may comprise any suitable material such as rubber, plastic, or other hydrophilic and/or injectable water-stop materials as would be understood by someone skilled in the field of water-bars, water-stops or hydrophilic materials. Double-sided discrete locator element 102 engages on both sides with angled walls 60, preferably in a resilient manner. It is installed by flexibly clipping into place at discrete locations or more preferably by travelling slidably downwardly along wings 60. An upstanding member 103 on water-stop locator element 102 grips (e.g. by means of clips, adhesive, friction fit etc.) continuous water-stop 100. Thus, multiple discrete locator elements 102 are provided spaced apart along the length of elongate water-stop 100 in a ladder-type arrangement. Preferably, locator element 102 is provided with two upstanding members 103 for engaging with opposing water-stops 100 adjacent each distal ends of each angled wall 60 (see FIG. 18).

Figure 19:
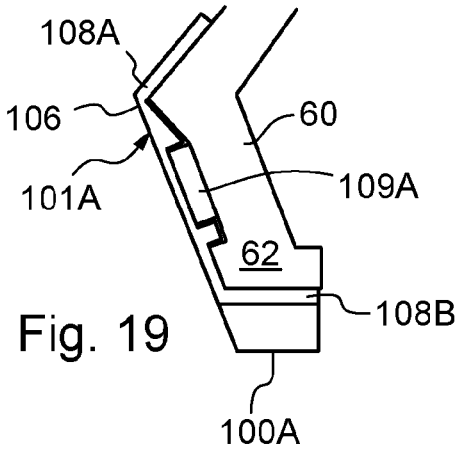
FIGS. 19, 20, 21, and 22 show plan, cross-sectional views of four versions of water-stop locator elements, here elongate carriage member(s) for water-stop(s) for locating the water-stop(s) at or near the distal end(s) of at least one wing of the guideway track. These may be one-sided (see FIGS. 19 to 21) or double-sided (see FIGS. 22, and 29 and 30).
Figure 20:
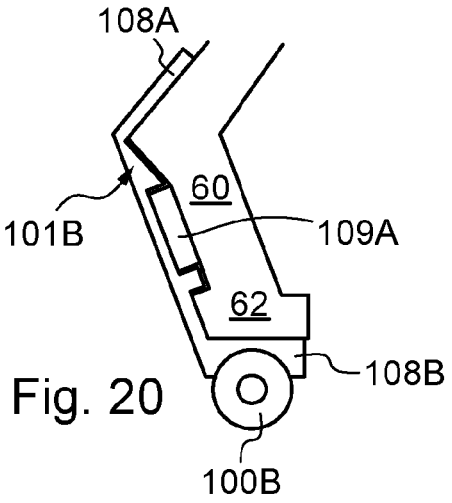
Figure 21:
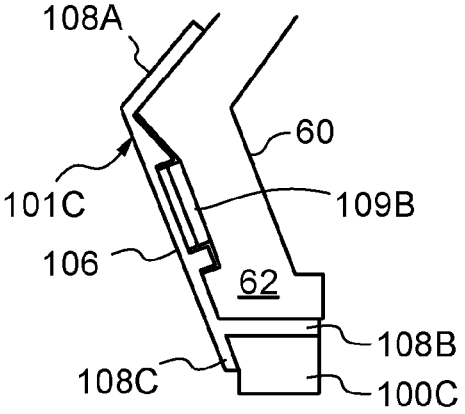
Figure 22:
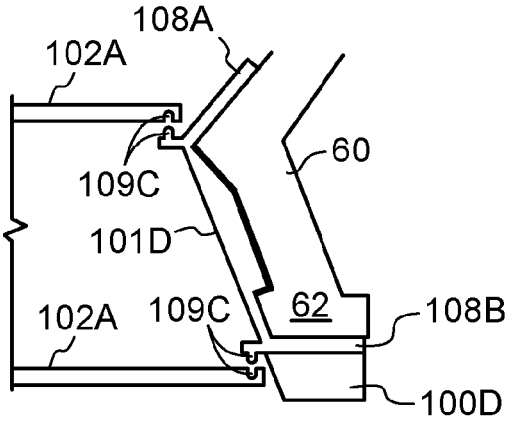
Figure 29:
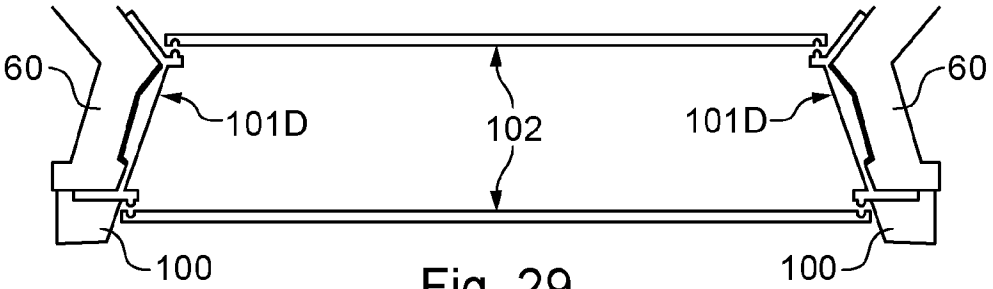
FIGS. 29 and 30 show plan, cross-sectional views of a double-sided water-stop locator element co-operating with two respective elongate carriage members for water-stop(s), for locating the water-stops at or near the distal end(s) of each wing of the guideway track.
Figure 30:
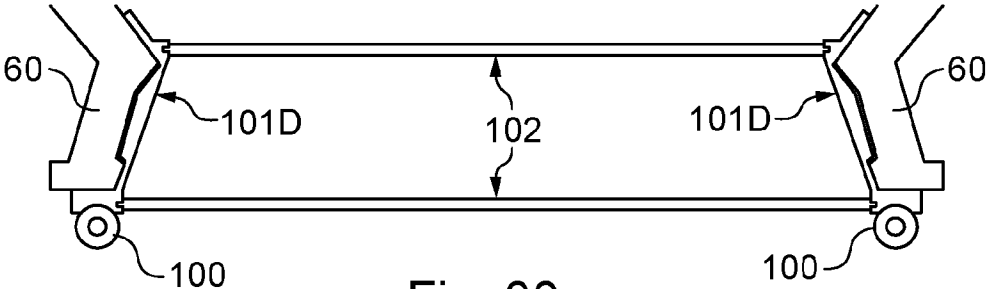

Several preferred versions of water-stops 100A, 100B, 100C, 100D and water-stop locator members in the form of elongate carriage members 101A, 101B, 101C, 101D are shown in FIGS. 19, 20, 21, and 22. Elongate carriage members 101A, 101B, 101C, and 101D in FIGS. 19 to 22 are continuous, extending along inwardly-facing side surfaces of one or both wing(s) 60, unlike those shown in FIGS. 17 and 18. In FIG. 19, an elongate carriage member 101A is formed from a continuous plastic extrusion 106 with two side front and rear wing elements 108A and 108B for gripping the angled wall 60 of guideway track 50. Preferably, additional adhesion is provided by a contact adhesive tape 109A between wing 60 and elongate carriage member 101A to hold it in position. Front wing element 108B (here a panel) grips a hydrophilic and/or injectable water-stop element 100A (with a trapezium cross-section) in any suitable manner e.g using glue, clips, friction etc. In FIG. 20, a circular hydrophilic and/or injectable water-stop element 100B is shown gripped or glued within a recess of front wing element 108B of elongate carriage member 101B. Again, a contact adhesive tape 109A is preferably used to hold elongate carriage member 101B in position on wing 60. In FIG. 21, an alternative trapezium-shaped water-stop 100C is held in position by co-operating front panel members 108B and 108C at an acute angle to each other using, for example, friction, glue, tacking, pins, or the like. Elongate carriage member 101C is held in place by heavy duty Velcro strips 109B on angled wings 60. In all these embodiments, preferably a rear wing element 108A (here a panel) co-operates with front wing element(s) 108B to ensure that water-stop(s) 100A, 100B, 100C, 100D are accurately held in a known position adjacent the elongate distal end of wing(s) 60. In FIG. 22 and FIGS. 29, 30, elongate carriage member 101D is supplemented by discrete horizontal clip (or push) members 102A via co-operating clip (or push) features 109C to form a double-sided water-stop locator member in a ladder-type arrangement. Elongate carriage members 101A, 101B, 101C, and 101D are typically continuous plastic extrusion(s), and are held on each wing by the front and rear co-operating side wing elements 108A, 108B (here side panels), thus also providing accurate location of continuous vertical water-stop elements 100A to 100D adjacent to the distal end 62 of angled wings 60.

Figure 23:
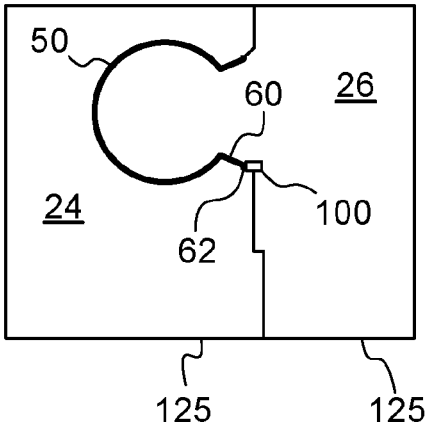
FIGS. 23, 24, 25, and 26 show stages 1 to 4 of a process for inserting firstly, a first (generally or substantially) vertical water-stop (FIG. 23), secondly drilling horizontally to the vertical water-stop (FIG. 24), thirdly, providing a second (generally or substantially) horizontal water-stop (FIG. 25), and, fourthly, optionally inserting a sheet of water-stop or waterproof or water resistant material in stage 4 (FIG. 26) e.g. to protect a floor slab from ingress of water.
Figure 24:
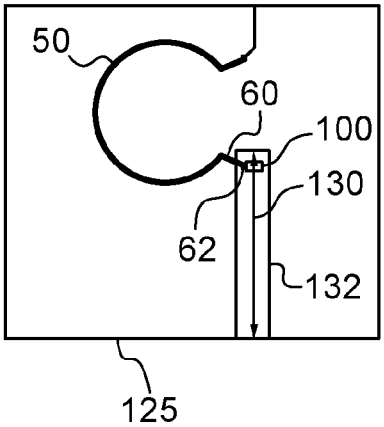
Figure 25:
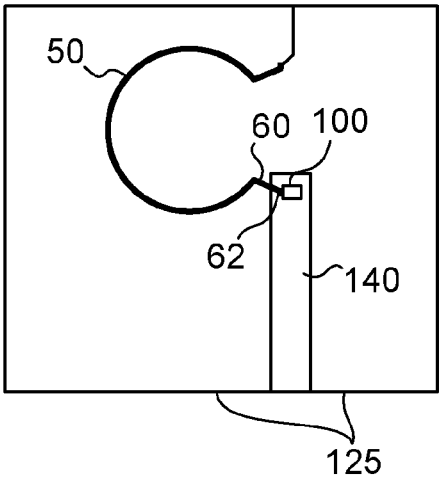

FIG. 23 shows guideway track 50 embedded within first and second concrete panels 24, 26. A continuous vertical water-stop 100 is located adjacent to distal end 62 of one angled wing 60, typically the wing closest to the exposed face 125 of the diaphragm wall. The position of the distal end 62 of angled wing 60 and, therefore, of water-stop 100 is accurately known or can be accurately determined (e.g. using an inclinometer lowered within guideway track 50 before concreting second panel 26 as would be well known by those skilled in the art). First panel 24 is joined to second concrete panel 26. An exposed face 125 of the diaphragm wall is shown. In a second stage, a horizontal drilling hole 132 may be made along a horizontal line 130 from the exposed face 125 of the diaphragm wall to intersect with the known position of water-stop 100, preferably near the base of the diaphragm wall. In a third step, drill hole 132, shown in FIG. 24, is filled with suitable water-stop material e.g. hydrophilic and/or injectable water-stop material (as understood by those skilled in this field), to form a generally or substantially horizontal water-stop 140 linking with vertical water-stop 100 to provide a double element water-stop arrangement.

Figure 26:
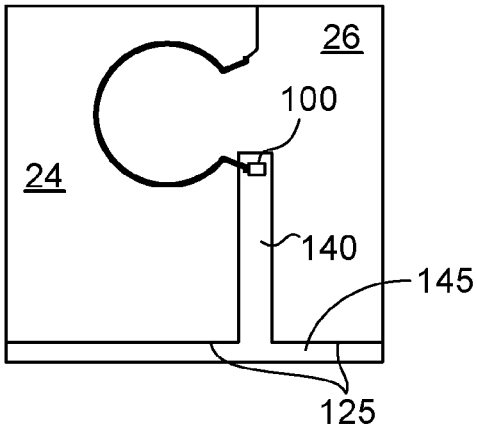

In FIG. 26, optional step 4, the exposed face 125 of the diaphragm wall may be covered with a sheet or panel of water-proof or resistant material 145 to provide a triple water-stop system comprising vertical water-stop 100 and horizontal water-stop 140 and two-dimensional water-stop sheet 145 near the base of the diaphragm wall. These act in concert, like damp-proof courses substantially preventing water from travelling inwards from the outside diaphragm wall, through the diaphragm wall, and past the exposed face 125 of the diaphragm wall into the internal space, substantially preventing water ingress into the internal space from outside the wall (24, 26).

Figure 27:
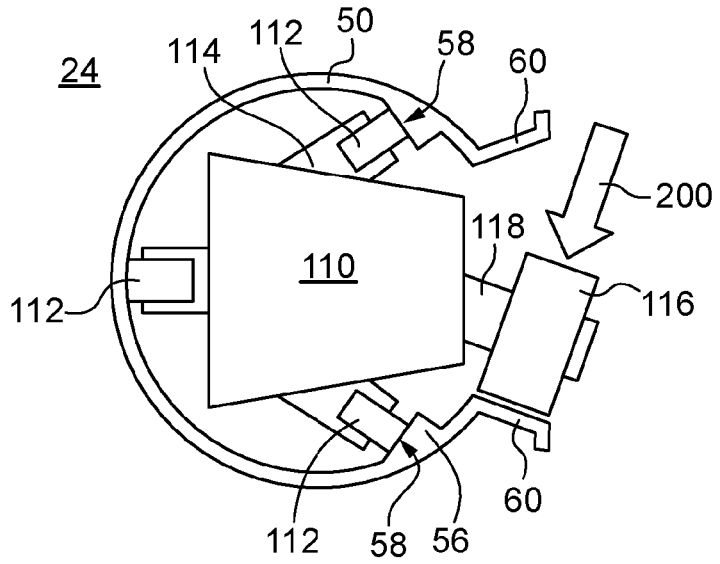
FIG. 27 shows a schematic plan, cross-sectional view of a guideway track and a bogey (a small vehicle within a tube) adapted for travelling within the guideway track using the bearing panels and providing a resiliently mounted push member e.g. a push wheel, for pushing an elongate carriage member onto the exposed face of the wings of the guideway track.

FIG. 27 shows a vehicle 110 (known as a bogey) installed within guideway track 50 having wheels or bearing surfaces 112 in mounts 114 which preferably engage with internal bearing surfaces 58 of guideway track 50. A push member 116, which may be in the form of a bearing surface but is preferably in the form of a wheel, is spring mounted by a mount 118 onto the main body of vehicle 110 so that push member 116 can be used to engage with elongate carriage members 101 (especially when formed as a continuous plastic extrusion) such as those seen in FIGS. 19 to 22 and to push these (in direction 200) into place onto angled wing 60 optionally into contact with a piece of tape or Velcro or other fastening means or the like.

The edges of slot 44 and, in particular, the angled walls 60 of guideway track 50 provide very precise positioning of both closure panel 70 and any later water-stops that are installed in relation to the guideway track. The position of the edges of slot 44, extended slot 144 and the angled walls 60 are precisely known or can be determined (using an inclinometer), allowing intersection with additional water-stop features (as described) in FIGS. 23 to 26. Furthermore, the edges of slot 44, 144 or more preferably, wing(s) 60, provide accurately positioned "rails" along which additional elements such as water-stop locator members can be slidably located.

GFRP is used for guideway track 50 and is typically pull-truded, in other words, extruded by pulling with fibres in a longitudinal direction such that it has similar tensile strength to steel in the longitudinal direction. The addition of transverse fibres, for example in the form of a mesh of both longitudinal and transverse fibres facilitates compression strength, resisting compression from slurry and concrete and tension strength to resist lateral extraction forces from the action of the milling machine 10 on the guideway track via bearing surfaces 58 and later, if required, tension connections such as using tension bars 150.

In use following the passage of milling machine 10, teeth 38 typically leave a variation in the depth of features over the surface of around 10 mm and a variation in the distance from the outermost surface of the front of the closure panel 70 of around 15 mm±5 mm. In use, following the removal of a stop end former, a depth of concrete of around 20 mm to 200 mm may be left in front of the outer surface of closure panel 70. Typical diameters of the guideway tube are between 100 and 300 mm and, more typically, around 1500 or 160 mm and around 250 mm. Typical lateral separations for a pair of guideway tubes embedded in an end face are around 600-800 mm, more typically around 680 mm, and a typical width of a concrete panel may be 800-1500 mm, more typically around 1000-1200 mm. Typical thickness of the guideway tube walls may be between 3-8 mm and, more typically around 4, 5, or 6 mm.

Where guideway track 50 is to be used as a tension connection between adjacent concrete panels, its thickness may be increased to provide additional lateral strength when under tension. For example, the wall thickness of the diaphragm tube may be 10, 12, or 14 mm. The shear key features 54 may also be increased in size and height above the outermost surface of guideway track 50.

Using GFRP is more expensive than other materials such as plastic but it provides both longitudinal and horizontal or, rather, lateral strength, which is required so this is preferred option although other materials may be used. However, closure panel 70 may be made of lower cost material as this is a sacrificial element. It should be remembered that closure panel 70 may be made in individual sections of, say, 1 m in length (along the guideway tube). Alternatively, closure panel 70 may be made in a continuous structure, optionally with transverse lines of weakness extending laterally across so that as the guide 34, with angled profiles 35, travels in the guideway track, closure panel 70 (or individual closure panel sections) is/are pushed out and, during this action, breaks apart into predetermined lengths of, say, around 1 m. The closure panel may be manufactured as a continuous element, (with or without transverse lines of weakness) and, used in this format or may be cut into individual lengths of e.g. 1 m. The provision of angled wings 60 and a push-out, preferably frangible, closure panel 70, ensures that, once closure panel 70 is removed, the remaining angled wing(s) 60 of guideway track 50 are of a well-defined shape and position. This means that guideway track 50 can indeed be used as "track(s)" or "rail(s)" along which further elements may be moved (e.g. slid) and/or accurately positioned. This facilitates the introduction and accurate placement of, for example, water-stops and delivery systems for water-stops such as one and two-sided water-stop locator members as described elsewhere herein. Indeed, once a water-stop, which is continuous, has been placed along the continuous free distal end of one or more angled wings 60, then the position of that water-stop is typically very well known or can be accurately determined. Even should the verticality of the guideway track vary along end face 28 of the concrete wall panel, the verticality variation can be mapped using an inclinometer. Thus, when viewed from above, the x-y position of the water-stop 100 can be accurately known and, as shown in FIG. 24 a horizontal bore to it can be provided (relatively) confident that the horizontal bore will engage with and meet the lower end of the water-stop 100 even at immense depths. Once filled with suitable water-stop material, this forms a continuous water-stop between the horizontal water-stop 140 and the vertical water-stop 100 located on the angled wings 60. This two part water-stop system represents considerable advantage over previous versions in which a horizontal water-stop would not necessarily connect or interact with the vertical water-stop because the precise position of the vertical water-stop at immense depths was imprecisely known. Furthermore, a three part water-stop system may be provided by installing a water-stop panel 145 along an inner face 125 of the diaphragm wall 24, 26 to connect with the horizontal water-stop 140 reaching into the diaphragm wall. This provides continuity of water-stop features, essentially wrapping the base of a diaphragm wall and an associated floor slab in waterproof or hydrophilic water-stop material. Where a base slab is provided, and this is pretty typical, the base slab is now isolated from incoming water seeping through the construction joints of the diaphragm wall. This also represents a considerable improvement over previous methods of installing water-stops.

Indeed, where a delivery vehicle 110 such as a bogey is provided with a spring-loaded push member 116, such as a wheel, pressing against the inner surface of angled wing 60, a second push member or wheel (not shown) may be provided for carrying out the same action on the opposing angled wing 60, for example, above or below the first wheel. On the way down, the vehicle pushes and fixes the water-stop locator member(s) 101, 101A to D, 102 (e.g. continuous plastic extrusions) onto the angled wing 60. The water-stop locator member(s) 101A to D, 102 typically carry a water-stop 100 fixed to it which is now fixedly and accurately located in a known position with respect to the angled wing(s) 60.

The rear panel 72 of the closure panel 70 preferably has a geometry that resists compression. Typically this is a curve such as a parabola. More preferably this is of circular cross-section.

The present invention differs from apparatus and methods that use removable shuttering because a guideway tube of width narrower than the width of the concrete panel is deliberately embedded and remains within the concrete during the casting of both the first and second panels. Indeed, where GFRP is used this is particularly advantageous as it can be made of similar strength and durability as concrete so does not represent a weak point in the wall even though it is left in place.

The closure panel 70 may be any suitable shape such as a wedge shape but it preferably includes a hollow section for lightness and, more preferably, includes elongate recesses 76 along outwardly facing surfaces opposite elongate angled wings 60. This facilitates accurate positioning of both the rear panel 72 and co-operating bearing surfaces 68A and 68B and the front panel 74 and recessed corner 77 on exposed corner surfaces 64, 65.

Figure 28:
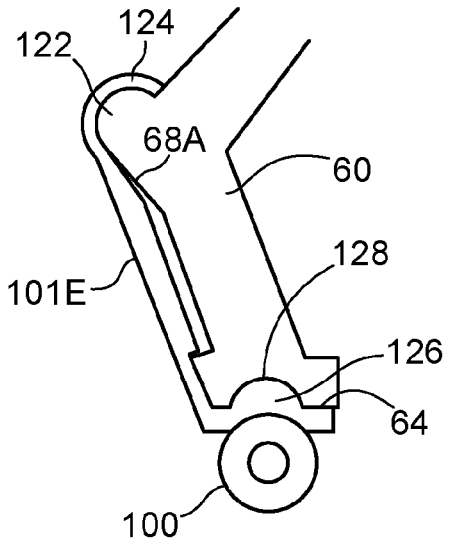
FIG. 28 shows a plan cross-sectional view of a one-sided carriage member for locating a water-stop e.g. on the side of the guideway track nearest an exposed face of the concrete wall.
Figure 31:
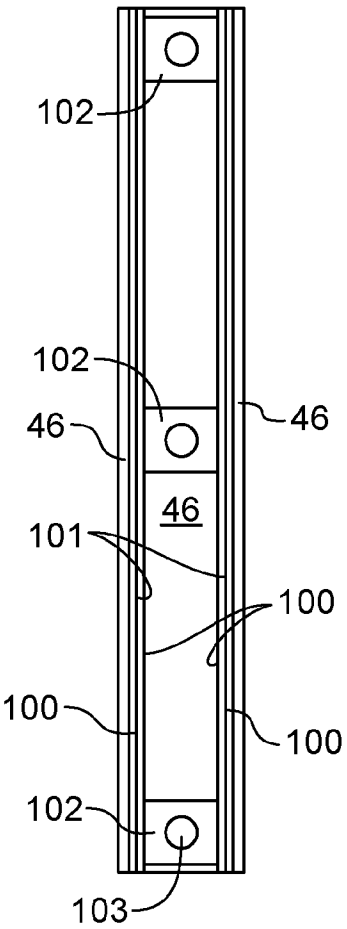
FIG. 31 shows a cross-sectional elevation view of the elongate carriage member(s) of FIGS. 29 and 30, and co-operating vertically spaced double-sided locator elements.

FIG. 28 shows an elongate carriage member 101E is shown located on a specially profiled wing 60 having a first (here bulbous) protrusion 122 projecting inwardly for engaging a first recess 124 of carriage member 101E, and a co-operating second (here bulbous) protrusion 126 for engaging a second recess 128 on face 64. Typically elongate carriage member 101E is a resilient, continuous extrusion (e.g. of plastic) designed to clip onto or travel on wings 60. Water-stop 100 may be circular in cross-section or any other suitable shape, e.g. square, triangular, rectangular, trapezium shaped. It will be apparent that other shapes of inter-engaging features and arrangements facilitating slidability may be used FIGS. 29, 30, and 31 show elongate carriage members 101 holding water-stops 100 against wings 60, and vertically spaced clip members 102, holding elongate carriage members 101 in position. Clip members 102 may be vertically separated every 500 to 1000 mm or thereabouts. Typically, clip members 102 comprise a plastic sheet of around 100 mm in height with one or more holes 103 to assist in distribution of concrete. The elongate carriage members 101, and clips 102 and water-stops 100, are placed in position along wing(s) 60 of guideway track(s) 50 following concreting of first panel 24 and before concreting of second panel 26.

Whilst the invention is particularly suitable for use with a milling machine (e.g. as shown in FIGS. 1 and 2) it may be used within a ram, lance or wedge and/or a stop end former of form and shape well known in the art, particularly in shallow diaphragm walls of up to around 30-40 m in depth.

In a first step an elongate stop end former is placed along the height of an 'end wall' of a first trench, e.g. a rectangular trench filled with bentonite slurry. In a second step a reinforcement cage with at least one guideway tube 32 according to the invention and preferably two, laterally spaced guideway tubes 32, is lowered into the slurry filled trench with the guideway tube(s) near the stop end former. Next, the first trench is filled with concrete and allowed to harden. In a fourth step, a second trench is dug adjacent the stop end former. Next, the stop end former is peeled off using equipment and techniques well known in the art e.g. using a grab. In a sixth step, a ram, lance or wedge or the like (which may be vibrating) is used to lever off or push out, closure panel 70 (and any remaining concrete and soil in front of it) from the guideway tube(s) to expose slots(s) 44, 144. Optionally, in a seventh step a second reinforcement cage with one or more optional tension connectors 150A (see FIG. 15) connected to it is lowered into the second trench, preferably with enlarged distal free end(s) of the tension connector(s) engaged in and travelling down within the internal volume V1 of guideway track(s) 50.

Once the reinforcement cage (and any tension connector(s)) are at a desired depth, then next, the second trench is filled with concrete which encompasses the reinforcement cage and the tension connectors and the enlarged end(s) of tension connector(s) in the now open guideway track 50. As shown in FIG. 40 such enlarged ends produces a bearing force F on bearing surfaces 58, 98, 158 providing a tension connection between the first and second concrete panels.

Figure 32:
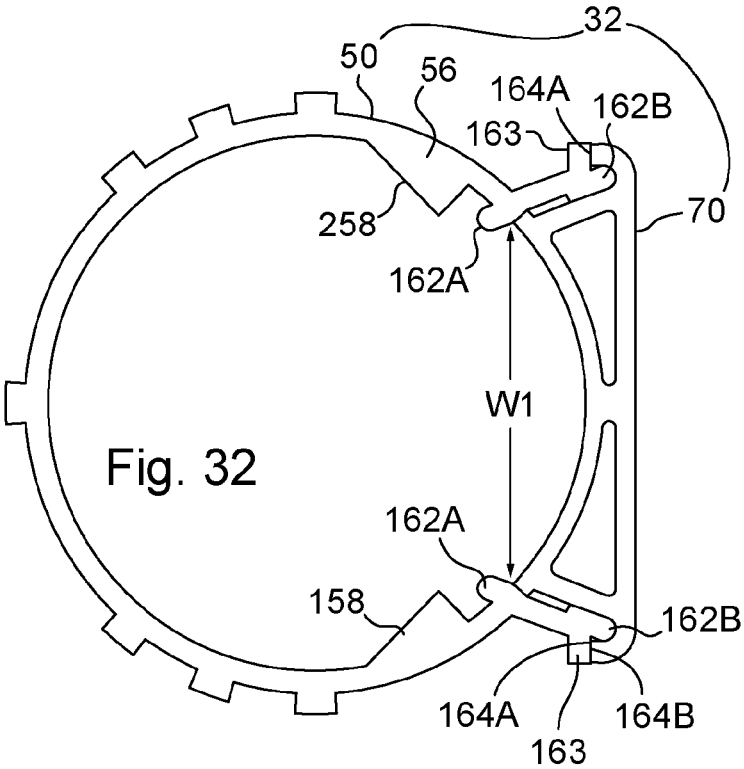
FIG. 32 shows a plan, cross-sectional view of a guideway tube comprising a guideway track and closure panel particularly suitable for a tension connection in a further embodiment of the invention.
Figure 33:
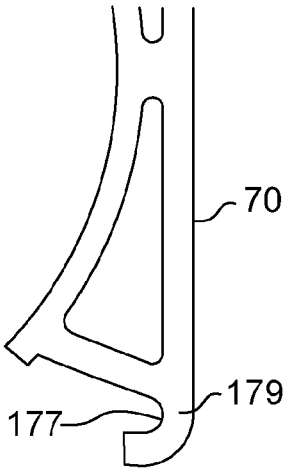
FIG. 33 shows a close-up, plan, cross-sectional view of the closure panel of FIG. 32.
Figure 34:
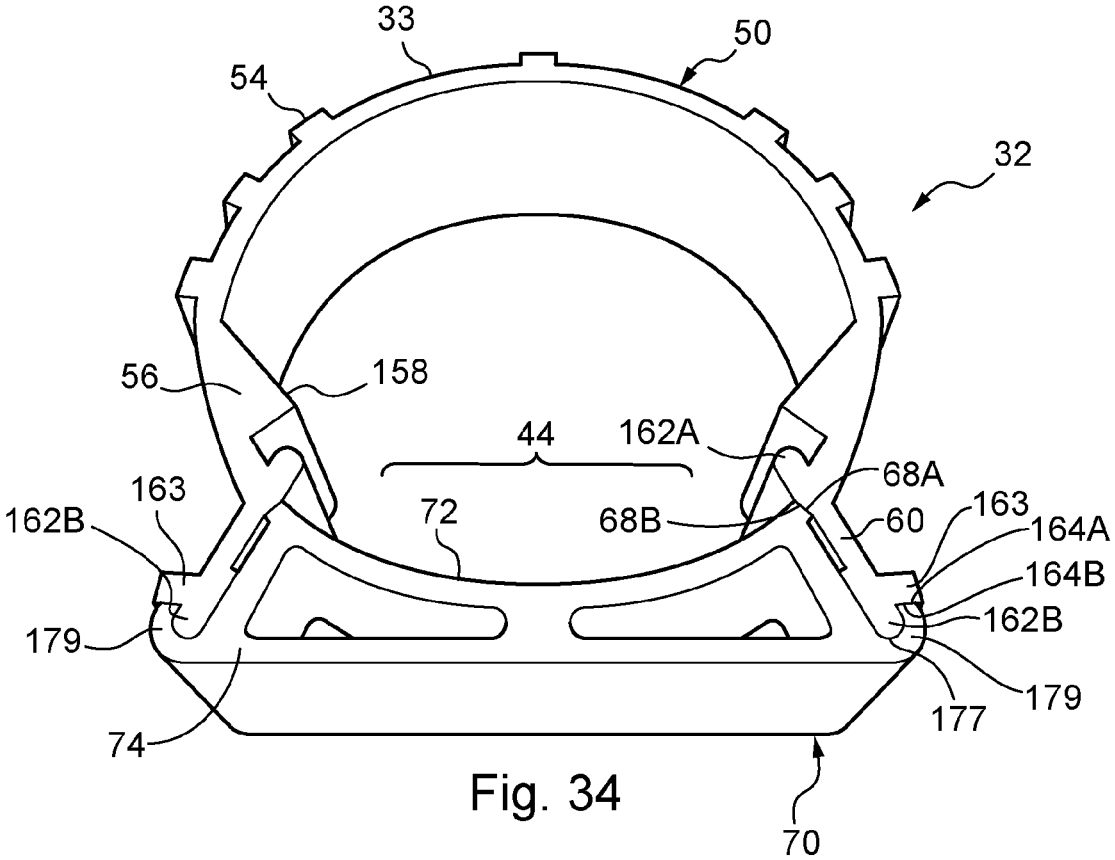
FIG. 34 shows a cross-sectional, perspective view of the guideway tube (including a guideway track and closure panel) of FIGS. 32 and 33.

Turning now to FIGS. 32, 33 and 34 a guideway track 32 comprising a guideway tube 50 and closure panel 70 is shown. Elongate wings 60 of guideway tube 50 here comprise (in cross-section) inwardly and outwardly projecting rear and front free distal profiled (here rounded) ends (also known as edges) 162A, 162B respectively. The rear and front distal ends (edges) 162A, 162B are profiled (here rounded in a semi-circular profile and of approximately the same size and in line with a central portion of the wing 60) to provide inter-engaging features along which elongate carrier member 201 can slide.

On the outer side of front distal edge 162B an elongate (in cross-section short) laterally extending side wall 163 is provided. This is mirrored on both elongate wings 60. Each laterally extending side wall 163 has a front facing elongate flat contact surface 164A which cooperates with a corresponding rearwardly facing elongate flat contact surface 164B of closure panel 70.

Closure panel 70 has two elongate side extensions 179, each with a corner recess element 177 sized and shaped to cooperate with and encompass front distal edge(s) 162B. Here corner recess element 177 is semi-circular in cross section. Opposing elongate flat contact surfaces 164A, 164B provide a close fit against each other so that concrete is substantially prevented from traversing the path between these surfaces to front distal end 162B and corresponding corner recess 177. The two side extensions 179 of closure panel 70 assist in holding the closure panel 70 to guideway track 50. When the closure panel 70 is removed, the front facing elongate flat contact surface and front distal edge(s) 162B are exposed and typically remain substantially free from concrete facilitating their use as rails of well-defined position along which water-stop locator elements may be slid.

Figure 35:
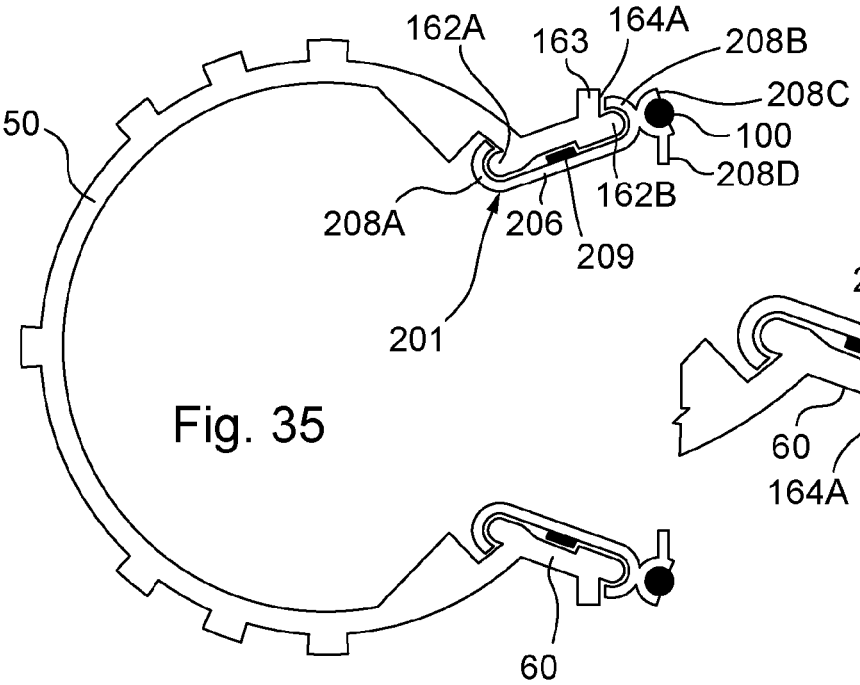
FIG. 35 shows a plan, cross-sectional view of the guideway track of FIG. 33 and an associated elongate water-stop carriage member.
Figure 36:
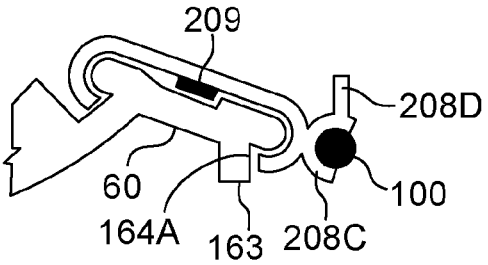
FIG. 36 shows a close-up, plan, cross-sectional view of the guideway track and elongate water-stop carriage member of FIG. 35.
Figure 37:
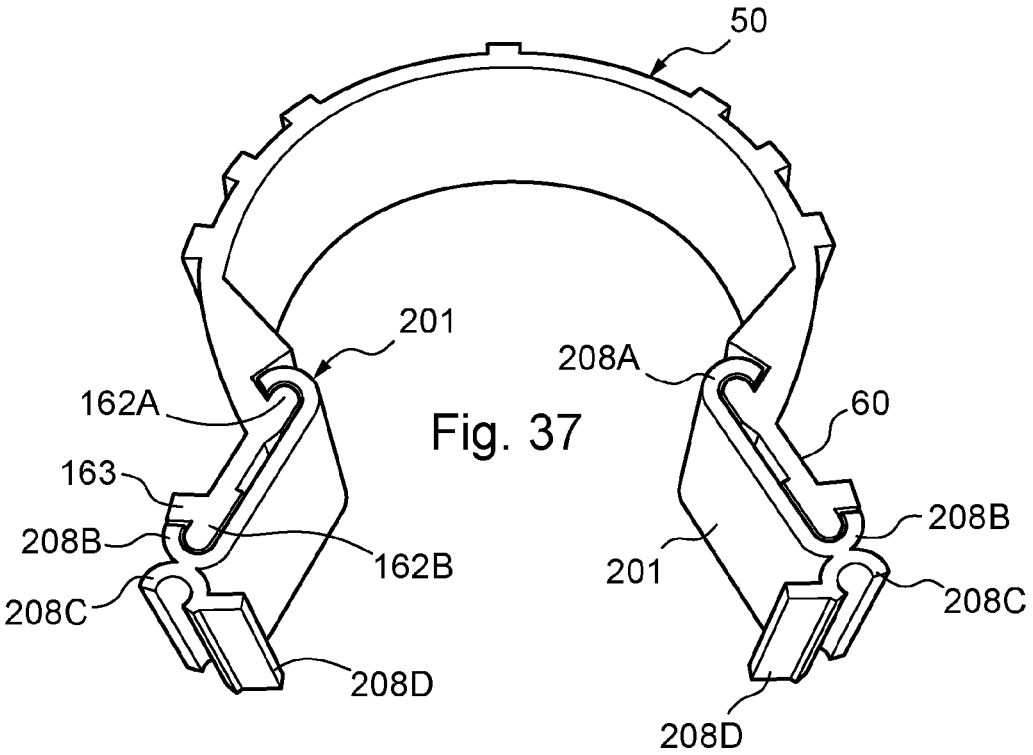
FIG. 37 shows a perspective cross-sectional view of the guideway track and elongate water-stop carriage member of FIGS. 35 and 36.

A water-stop locator member here in the form of an elongate water-stop carrier member 201 is shown in FIGS. 35, 36 and 37. Water-stop carrier member 201 comprises rear grip element 208A having an elongate, profiled (here rounded) recess for engaging and travelling along free rear distal edge 162A, and a front grip element 208B for engaging and travelling along free front distal edge 162B of wing 60. A further attachment mechanism may be provided in the form of an elongate strip 209 of glue or VELCRO or the like.

Water-stop carrier member 201 comprises near a front portion an outwardly facing elongate shaped recess member 208C for receiving and retaining a water-stop member here hydrophilic rope 100. The rope 100 may be glued, friction fitted or otherwise affixed within recess member 208C. It can be seen that the positioning of elongate recess member 208C facilitates accurate positioning of rope 100 on wings 60 near front distal edge(s) 162B.

One and typically two opposing elongate crack inducer members 208D are provided extending inwardly, preferably generally or substantially parallel to the end face of a concrete panel. These crack inducer members 208D facilitate formation of a crack along a plane between their elongate (in use vertical) free distal edges (not labelled). Typically, these each depend from an inwardly facing wall of shaped recess member 208C and extend inwardly towards one another. Thus, upon drying of the concrete of the second panel, any cracking is preferentially induced along and across this plane i.e. next to (in use) vertical hydrophilic rope 100 where the water-stop for the diaphragm wall is located.

The present invention differs from apparatus and methods of WO2013/0079868 COUPLAND because the guideway tube of the present invention has a well-defined opening or slot 44, and a well-defined co-operating closure panel 70 for closing slot 44, until the appropriate stage. Once the closure panel 70 is removed (either as a continuous piece, in broken pieces, or in well-defined closure panel sections), the exposed slot 44, 144 is well-defined in width and shape, providing the opportunity to use edges of slot 44, or preferably wings 60 where provided, of the guideway track as rail(s) for locating water-stops thereon.

Variations on the enclosed embodiments can be envisaged by those skilled in the art from the disclosure herein, and all such embodiments are intended to form part the invention.

The invention claimed is:

1. A guideway tube for casting into a concrete panel of a diaphragm wall along a height of a face of the concrete panel, the guideway tube comprising:

an elongate guideway track having an elongate internal volume for receiving a guide to travel therealong, the guideway track comprising at least one elongate side wall and an elongate slot along the at least one elongate side wall, the elongate slot having a first width; and a removable elongate closure panel comprising:

a rear panel portion configured to close the elongate slot in the at least one elongate side wall and, along with the at least one elongate side wall, configured to form a ring-shaped side wall of continuous periphery enclosing the elongate internal volume; and a front panel portion of a second width greater than the first width, whereby the removable elongate closure panel can be pushed out from the elongate slot when a guide travels along the elongate internal volume.

2. A guideway tube according to claim 1, wherein the at least one elongate side wall of the guideway tube comprises two opposing elongate first free end faces defining the elongate slot, and the rear panel portion comprises two co-operating elongate second free end faces that engage the first free end faces, enclosing the internal volume.

3. A guideway tube according to claim 1, wherein at least one of the following is provided: i) a the rear panel portion is curved or of substantially circular cross-section and/or ii) the guideway tube is of generally or substantially circular cross-section.

4. A guideway tube according to claim 1, wherein the guideway track comprises one, or two, elongate wings each extending externally from the at least one side wall adjacent the elongate slot, or adjacent the respective free end faces of elongate slot, where provided, to form an extended elongate slot.

5. A guideway tube according to claim 4, wherein the elongate wings each have at least one of: i) an enlarged distal end ii) a distal corner element, iii) an inwardly projecting profiled rear distal edge, iv) an outwardly projecting profiled front distal edge, or v) an elongate side wall recess facing inwardly along a central portion of an inner face.

6. A guideway tube according to claim 1, wherein an elongate closure panel side wall is provided between distal ends of rear and front panel portions.

7. A guideway tube according to claim 1, wherein the front panel portion comprises two elongate side extensions at each lateral elongate edge thereof for engaging with a distal end, or with an outwardly projecting profiled front distal edge where provided, of a respective wing.

8. A guideway tube according to claim 1, wherein the guideway track comprises one, or two opposing, elongate bearing panel element(s) internally protruding from an internal surface thereof, each having an elongate bearing face (58, 98, 158) angled in a direction to resist lateral extraction forces.

9. A guideway tube according to claim 1, wherein the guideway track comprises one or more elongate shear key elements extending from an external surface thereof.

10. A guideway tube according to claim 1, wherein the closure panel is connected to the guideway track by a frangible attachment mechanism.

11. A guideway tube according to claim 1, comprising at least one of the following:

the guideway track is made of a material of higher mechanical strength and the closure panel is made of a material of lower mechanical strength respectively;

the guideway track is made of a Glass Fibre Reinforced Plastic, and the closure panel is made of plastic;

the guideway track is made of a GRFP having both longitudinally and laterally laid fibers therein, and the closure panel is made of plastic; or the guideway track is made of a GRFP having both longitudinally and laterally laid fibers therein, and the closure panel is made of GRFP having, only longitudinally positioned fibers therein.

12. A guideway tube according to claim 1, wherein the closure panel is formed from a plurality of inter-engaging closure panel sections.

13. An apparatus comprising:

at least one of guide tube for casting into a concrete panel of the diaphragm wall along a height of a face of the concrete panel, the guideway tube comprising: an elongate guideway track having an elongate internal volume for receiving a guide to travel therealong, the guideway track comprising at least one elongate side wall and an elongate slot along the at least one elongate side wall, the elongate slot having a first width; and a removable elongate closure panel comprising: a rear panel portion configured to close the elongate slot in the at least one elongate side wall and, along with the at least one elongate side wall, configured to form a ring-shaped side wall of continuous periphery enclosing the elongate internal volume; and a front panel portion of a second width greater than the first width, whereby the removable elongate closure panel can be pushed out from the elongate slot when a guide travels along the elongate internal volume;

at least one water-stop locator element; and a continuous elongate water-stop for positioning near or adjacent the elongate slot along a height of the guideway track, wherein the guideway track comprises two elongate wings each extending externally from the at least one side wall adjacent elongate slot to form an extended elongate slot, and wherein the at least one water-stop locator element comprises at least one carriage member configured to engage one or more of the wing members to locate the water-stop near or adjacent the elongate slot, or the extended elongate slot, along a height of the guideway track.

14. An apparatus according to claim 13, wherein the carriage member is one or more of: i) one-sided, ii) elongate iii) continuous, iv) flexible, v) resilient, vi) snap-fitted to wing(s), vii) push-fitted to wing(s), and/or viii) slidable on wing(s).

15. An apparatus according to claim 13, wherein one or both wings 60 comprise at least one of an inwardly projecting profiled rear distal edge and/or an outwardly projecting profiled front distal edge, and wherein the water-stop locator element comprises at least one of a corresponding rear grip element and a front grip element sized and shaped to engage and travel along a respective front or rear distal edge(s).

16. An apparatus according to claim 13, wherein the water-stop locator element comprises a plurality of two sided discrete locator elements spaced apart along one (or two laterally spaced) water-stop elements.

17. A method of constructing a diaphragm wall comprising:

a) providing at least one of guide tube for casting into a concrete panel of the diaphragm wall along a height of a face of the concrete panel, the guideway tube comprising: an elongate guideway track having an elongate internal volume for receiving a guide to travel therealong, the guideway track comprising at least one elongate side wall and an elongate slot along the at least one elongate side wall, the elongate slot having a first width; and a removable elongate closure panel comprising: a rear panel portion configured to close the elongate slot in the at least one elongate side wall and, along with the at least one elongate side wall, configured to form a ring-shaped side wall of continuous periphery enclosing the elongate internal volume; and a front panel portion of a second width greater than the first width, whereby the removable elongate closure panel can be pushed out from the elongate slot when a guide travels along the elongate internal volume;

b) casting the guideway tube into a first concrete panel along a height of an end face of the panel;

c) separating the closure panel from the guideway track, and breaking any frangible connections between these, where provided, so as to open one or more slots exposing an internal volume of the guideway track; and d) pouring a second concrete panel, so that concrete enters the internal volume of guideway track.

18. A method according to claim 17 comprising: e) installing an elongate water-stop and positioning same near or adjacent the elongate slot, or the extended elongate slot where provided, of guideway track along a height of the guideway track.

19. A method according to claim 17 comprising:

f) drilling one or more, generally or substantially, horizontal bore(s) into the concrete panel, the bore(s) engaging the water-stop near or adjacent the slot of the guideway tube; and g) filling the bore with water-stop material (e.g. hydrophilic and/or injectable water-stop material.

20. A method according to claim 19 comprising:

h) installing a two-dimensional sheet of waterproof, water-resistant or water-stop material against a face of a concrete panel, the sheet engaging with the generally, or substantially, horizontal water-stop.

21. The method according to claim 17 further comprising:

i) installing an enlarged end of a tension connector into the guideway track.

* * * * *